US012757979B2

(12) United States Patent
Choi et al.

(10) Patent No.: US 12,757,979 B2
(45) Date of Patent: Oct. 13, 2026

(54) BLADDER SYSTEMS AND FOOTWEAR INCORPORATING BLADDER SYSTEMS FOR ANKLE AND/OR HEEL SUPPORT

(71) Applicant: NIKE, Inc., Beaverton, OR (US)

(72) Inventors: Yoon Jeong Choi, Portland, OR (US); Scott C. Holt, Portland, OR (US); James Molyneux, Portland, OR (US); Colin Runkle, Portland, OR (US); Bryan K. Youngs, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/213,569

(22) Filed: Jun. 23, 2023

(65) Prior Publication Data

US 2023/0413948 A1 Dec. 28, 2023

Related U.S. Application Data

(60) Provisional application No. 63/355,759, filed on Jun. 27, 2022.

(51) Int. Cl.
*A43B 23/02* (2006.01)

(52) U.S. Cl.
CPC ..... *A43B 23/0285* (2013.01); *A43B 23/029* (2013.01)

(58) Field of Classification Search
CPC ..... A43B 23/0285; A43B 23/029
See application file for complete search history.

(56) References Cited

U.S. PATENT DOCUMENTS 5,379,533 A * 1/1995 Swartz ..... A43B 3/0078 40/636
D392,791 S * 3/1998 Ng ..... D2/900
5,839,211 A * 11/1998 Pallera ..... A43B 1/0072 36/137
5,846,063 A 12/1998 Lakic
(Continued)

FOREIGN PATENT DOCUMENTS

EP 1233686 B1 6/2006

OTHER PUBLICATIONS

Oct. 18, 2023 (WO) International Search Report and Written Opinion—App PCT/US2023/026204, 13 pages.

*Primary Examiner* — F Griffin Hall
(74) *Attorney, Agent, or Firm* — Banner & Witcoff, Ltd.

(57) ABSTRACT

Bladder systems for footwear uppers, footwear components (e.g., uppers), and articles of footwear including the bladder systems, and/or methods of making and using such bladder systems are described. The bladder systems may include two or more bladder pods engaged together by one or more elastic connectors. The elastic connector(s) may enable the bladder system to fit snugly around the wearer's ankle and/or heel area while still allowing some relative movement between the bladder pods, e.g., as a wearer moves in an article of footwear. In this manner, the bladder systems provide support and a snug fit and return to its/their original size, shape, and/or location once the force from the wearer's movement is removed or sufficiently relaxed. Additionally or alternatively, the bladder systems may provide impact force attenuation properties, e.g., to protect the wearer's ankle and/or heel.

7 Claims, 10 Drawing Sheets

(56) References Cited

U.S. PATENT DOCUMENTS

| | | | | |
|---|---|---|---|---|
| 7,089,690 | B2 * | 8/2006 | Krstic | A43B 23/028 36/3 R |
| 8,677,652 | B2 * | 3/2014 | Marvin | A43B 13/203 36/50.1 |
| 9,351,536 | B2 * | 5/2016 | Schindler | A43B 23/029 |
| 9,737,114 | B2 * | 8/2017 | Beye | A43B 1/0027 |
| 10,051,919 | B2 * | 8/2018 | Leary | A43B 23/029 |
| 10,499,707 | B2 * | 12/2019 | Hobson | A43B 23/027 |
| 10,602,801 | B2 * | 3/2020 | Silva | A43B 7/141 |
| 2010/0218400 | A1 * | 9/2010 | Klatt | A43B 1/0036 36/72 R |
| 2020/0189171 | A1 | 6/2020 | Chan et al. | |
| 2021/0120915 | A1 | 4/2021 | Panian | |
| 2021/0145123 | A1 * | 5/2021 | Engel | A43B 23/027 |
| 2021/0368941 | A1 | 12/2021 | Chen et al. | |

* cited by examiner

BLADDER SYSTEMS AND FOOTWEAR INCORPORATING BLADDER SYSTEMS FOR ANKLE AND/OR HEEL SUPPORT

FIELD OF THE INVENTION

The present invention relates to bladder systems and footwear incorporating such bladder systems in the footwear uppers and/or methods of making and using such bladder systems, uppers, and/or articles of footwear. In some aspects of this technology, the bladder systems will include two or more bladder pods engaged with one or more elastic connectors.

BACKGROUND

Conventional articles of footwear include two primary elements, an upper and a sole structure. The upper may provide a covering for the foot that securely receives and positions the foot with respect to the sole structure. In addition, the upper may have a configuration that protects the foot and provides ventilation, thereby cooling the foot and removing perspiration. The sole structure may be secured to a lower surface of the upper and generally is positioned between the foot and any contact surface. In addition to attenuating ground reaction forces and absorbing energy, the sole structure may provide traction and control potentially harmful foot motion, such as over pronation.

SUMMARY

This Summary is provided to introduce some general concepts relating to this technology in a simplified form that are further described below in the Detailed Description. This Summary is not intended to identify key features or essential features of the invention.

Aspects of this technology relate to bladder systems, footwear components (e.g., uppers) including such bladder systems, and articles of footwear including such bladder systems, e.g., of the types described and/or claimed below and/or of the types illustrated in the appended drawings. In some aspects of this technology, the bladder systems will include two or more bladder pods engaged with one or more elastic connectors. Such bladder systems, uppers, and/or articles of footwear may include any one or more structures, parts, features, properties, and/or combination(s) of structures, parts, features, and/or properties of the examples described and/or claimed below and/or of the examples illustrated in the appended drawings.

While aspects of this technology are described in terms of bladder systems, footwear components including such bladder systems, and articles of footwear including such bladder systems, additional aspects of this technology relate to methods of making such bladder systems, footwear components, and/or articles of footwear and/or methods of using such bladder systems, footwear components, and/or articles of footwear.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

DETAILED DESCRIPTION

Figure 1A:
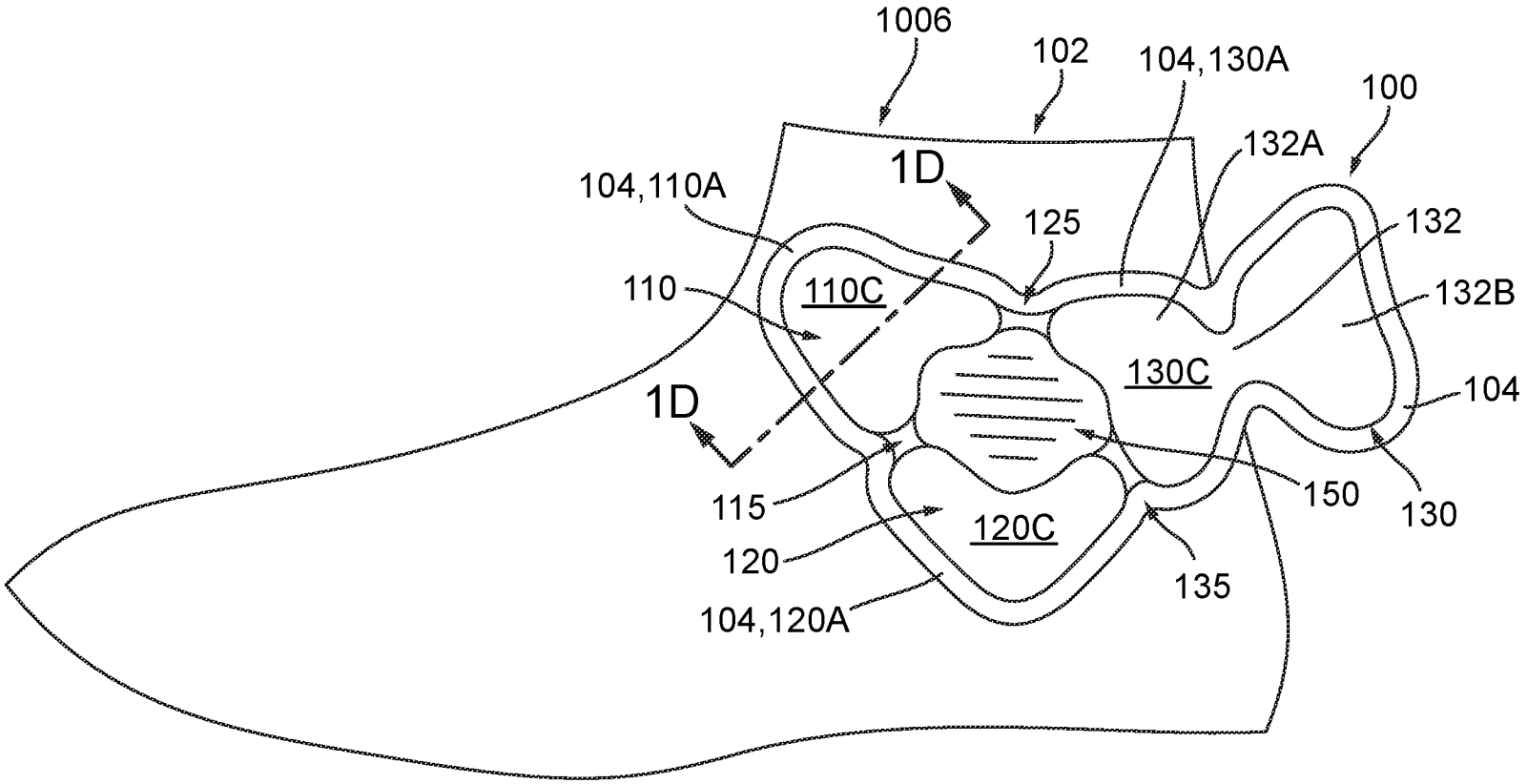
FIGS. 1A-1D provide various views of bladder systems, uppers, and articles of footwear in accordance with some examples and aspects of this technology.

In the following description of various examples of bladder systems, footwear components, and/or articles of footwear according to the present technology, reference is made to the accompanying drawings, which form a part hereof, and in which are shown by way of illustration various example structures and environments in which aspects of the technology may be practiced. It is to be understood that other structures and environments may be utilized and that structural and functional modifications may be made to the specifically described structures, functions, and methods without departing from the scope of the present disclosure.

This application describes footwear components (e.g., bladder system components, footwear components, etc.) that are "bonded" together. The term "bonded" (and derivatives thereof) means that the components are joined securely to one another. The term "bonded" encompasses bonds formed using adhesives or cements (including hot melt adhesives) as well as bonds formed in an "adhesive free" manner, i.e., without use of a separate adhesive component. "Adhesive free" bonds include bonds formed by fusing or melting components together (e.g., if the components include compositions that are compatible to mix and join together to form a bond, such as two components including a thermoplastic polyurethane component); bonds formed by welding techniques (e.g., RF welding, ultrasonic welding, high-frequency welding, laser welding, impulse welding, etc.); bonds formed by heat sealing; etc. Some adhesive free bonds may form a seamless joint between the two previously separate components (e.g., the materials mix and join together and then re-harden with no discernible junction). The term "melt bond" and variations thereof, as used herein, mean bonds formed where localized melting of each component occurs (e.g., melting of the thermoplastic polymer present in each component), the melted components combine together, and then the combined components harden to thereby "fuse" and "bond" the two components together. Such melt bonded joints are adhesive free and may be seamless. The term "engaged with" is used herein as a generic term and includes both adhesive based bonds and adhesive free bonds within its scope as well as other potential types of engagement that fix two (or more) components together (including through the use of mechanical connectors or fasteners, through the use of sewing or stitching, etc.).

This application and/or its claims use the adjectives, e.g., "first," "second," "third," and the like, to identify certain components and/or features relating to this technology. These adjectives are used merely for convenience, e.g., to assist in maintaining a distinction between components and/or features of a specific structure or structures. Use of these adjectives should not be construed as requiring a specific order or arrangement of the components and/or features being discussed. Also, use of these specific adjectives in the specification for a specific structure does not require that the same adjective be used in the claims to refer to the same part (e.g., a component or feature referred to as the "fourth" in the specification may correspond to any numerical adjective used for that same component or feature in the claims).

The term "elastic" as used herein refers to a physical property of an object that deforms under an applied force (e.g., stretches) and returns to its original shape and size after the deforming force is removed or sufficiently relaxed. The term "elastic connector," as used herein, means a "component" (which may include one or more parts) that spans between and/or joins two (or more) other components, wherein at least some part (e.g., one or more parts) of the spanning or joining component has "elasticity" or an "elastic" property. An "elastic connector," as used herein, spans or joins the two (or more) other components in a manner such that: (a) at least some portions of the two (or more) components can move with respect to one another under an applied force sufficient to elastically deform the elastic connector and (b) said portions of the two (or more) components move back to their original positions when the applied force is removed or sufficiently reduced such that the elasticity of the elastic connector returns the elastic connector to its original size and shape.

The term "elastic connector," as used herein, generically includes fabric or textile elastic components and/or hardware components (e.g., one or more springs). The term "fabric-type elastic connector" may be used herein to describe elastic connectors that possess elasticity due to stretch and return of an elastic fabric material. The term "hardware-type elastic connector" may be used herein to describe elastic connectors that possess elasticity due to the stretch and return of a hardware component. A "spring" is an example of a "hardware-type elastic connector." The term "spring-type elastic connector" may be used herein to describe elastic connectors that possess elasticity due to the stretch and return of a spring.

In at least some examples of this technology, an "elastic connector" will be capable of: (i) stretching in at least one dimension (e.g., in a direction directly extending between the connected components) by at least 20% (e.g., a 10 cm length of spring or fabric material can be stretched at least 2 cm), and in some examples, by at least 30%, at least 40%, at least 50%, or even at least 60% under an applied stretching force and (ii) return or rebound to its original size and shape when that force is removed or sufficiently relaxed.

A connector component may constitute an "elastic connector" as that term is used herein even if it is not made completely of an "elastic" material and/or completely from a hardware-type elastic connector. Rather, a connector may constitute an "elastic connector" as that term is used herein if at least a portion of the connector is made from an "elastic material" and/or a hardware-type elastic connector and the "elastic" material and/or hardware component is arranged in the connector (and with respect to the connected components) to provide the desired relative movement and return features.

In some examples, an "elastic connector" may be formed completely or in part from an elastomeric fabric material (a fabric-type elastic connector). Examples of such fabric materials include fabrics made from or including one or more of: rubber materials (natural and/or synthetic); elastomers; elastane; spandex; nylons; neoprenes; cholorprenes; butyl rubbers (GDP); fluoroelastomers; ethylene-propylene rubbers (EPR); styrene-butadiene rubbers (SBR); rubber epichlorohydrin; terpene; isoprene rubbers; polybutadienes; nitrile rubbers; stretchable vinyls; thermoplastic elastomers; silicone rubbers; ethylene-propylene-diene rubber (EPDM); ethyl vinyl acetate (EVA rubber or foam); and halogenated butyl rubbers (CIIR, BIIR).

Also, as used herein, the term "forefoot" (as in "forefoot portion," "forefoot region," or the like) relates to portions, regions, structures, or components located in and/or associated with a forward ⅓ of an article of footwear, sole structure, or component thereof; the term "midfoot" (as in "midfoot portion," "midfoot region," or the like) relates to portions, regions, structures, or components located in and/or associated with a middle ⅓ of an article of footwear, sole structure, or component thereof; and the terms "heel" or "rearfoot" (as in "heel portion," "heel region," "rearfoot portion," "rearfoot region," or the like) relate to portions, regions, structures, or components located in and/or associated with a rearward ⅓ of an article of footwear, sole structure, or component thereof.

I. GENERAL DESCRIPTION OF ASPECTS OF THIS TECHNOLOGY

As noted above, aspects of this technology relate to bladder systems, footwear components (e.g., uppers) including such bladder systems, and articles of footwear including such bladder systems. Such bladder systems, footwear components including such bladder systems, and articles of footwear including such bladder systems may include any one or more structures, parts, features, properties, and/or combination(s) of structures, parts, features, and/or properties of the examples described and/or claimed below and/or of the examples illustrated in the appended drawings.

Bladder systems for articles of footwear in accordance with at least some aspects of this technology include two or more bladder pods engaged with one or more elastic connectors. The bladder pods may include a seam that defines an interior bladder chamber (a fluid-filled chamber) for that pod. The bladder pods may be engaged with at least one other bladder pod by one or more elastic connectors, e.g., connectors that extend between and connect the pod seams that define the interior bladder chambers.

As a more specific example, some aspects of this technology relate to bladder systems for articles of footwear that include: (a) a first bladder pod including a first seam that defines a first interior bladder chamber; (b) a second bladder pod including a second seam that defines a second interior bladder chamber; and (c) a first elastic connector engaging the first seam and the second seam. Additional bladder pods may be included in the overall bladder system. Such additional bladder pods may be engaged with one or more of the other bladder pods in the overall system, e.g., by engaging with the first elastic connector, by engaging with another elastic connector, and/or by otherwise engaging with one or more of the other bladder pods (e.g., via a non-elastic connector).

Such bladder systems may be incorporated into an upper for an article of footwear. In such structures, the upper for the article of footwear may include: (a) an upper base component including one or more upper component parts; and (b) a bladder system of the types described above engaged with the upper base component. The bladder system may be located at an ankle covering portion and/or a heel covering portion of the upper base component and may be used to provide additional support and/or impact force protection for the wearer's ankle and/or heel.

Additional aspects and examples of this technology relate to bladder systems for articles of footwear that include: (i) a first bladder pod that defines a first interior bladder chamber; (ii) a second bladder pod that defines a second interior bladder chamber, wherein the first bladder pod and the second bladder pod are at least partially separated by a first gap; and (iii) a first elastic connector engaging the first bladder pod and the second bladder pod and spanning the first gap. The same first elastic connector may engage and connect to additional bladder pods and/or may span gaps between these additional bladder pods.

Still additional aspects and examples of this technology include uppers for articles of footwear that include: (i) a first bladder pod that defines a first interior bladder chamber; (ii) a second bladder pod that defines a second interior bladder chamber, wherein the first bladder pod and the second bladder pod are at least partially separated by a first gap; and (iii) a first upper component engaging the first bladder pod and the second bladder pod, wherein the first upper component includes a first elastic material portion located in the first gap. This same first upper component may engage additional bladder pods and/or may include additional elastic material portions located in gaps between these additional bladder pods. Thus, the elastic material connecting bladder pods may comprise an integral part of a material element forming a footwear upper.

Further aspects of this technology relate to articles of footwear including bladder systems and/or uppers of the various types described above (and those described in more detail below). Still additional aspects of this technology relate to methods of making the bladder systems, footwear components (e.g., footwear uppers), and/or articles of footwear described above (and those described in more detail below).

Given the general description of features, examples, aspects, structures, and methods according to aspects of this technology provided above, a more detailed description of specific example footwear uppers, bladder systems, articles of footwear, and methods in accordance with this technology follows.

II. DETAILED DESCRIPTION OF EXAMPLE BLADDER SYSTEMS, FOOTWEAR COMPONENTS (E.G., FOOTWEAR UPPERS), AND/OR ARTICLES OF FOOTWEAR ACCORDING TO ASPECTS OF THIS TECHNOLOGY

Figure 1B:
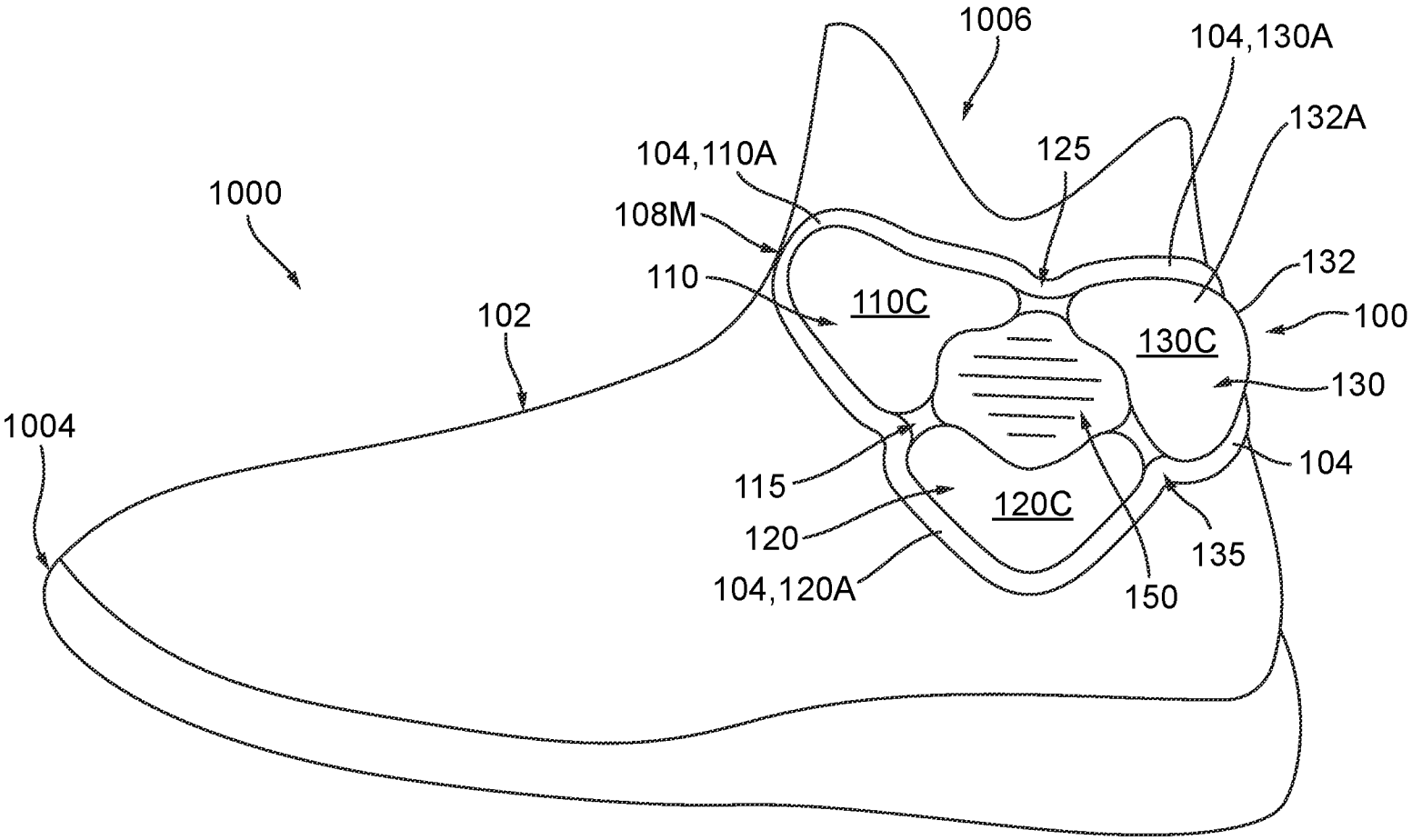
Figure 1C:
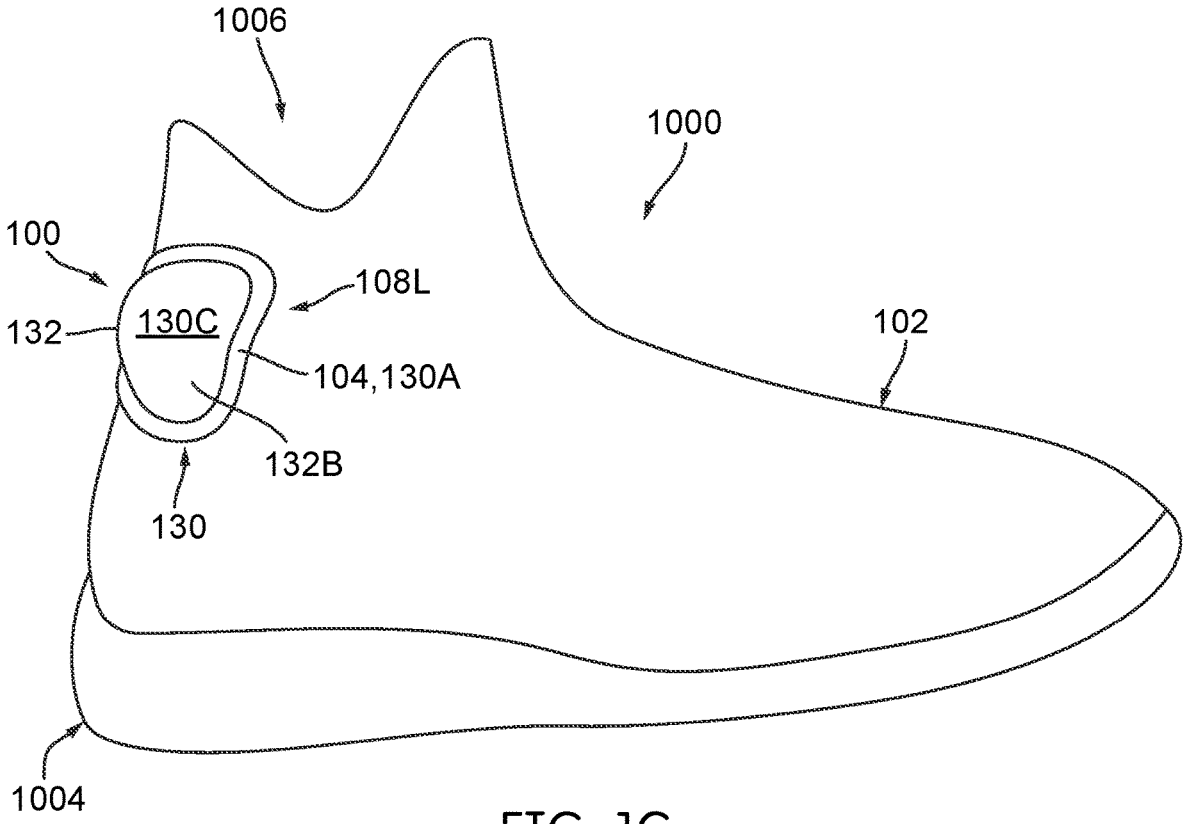
Figure 1D:
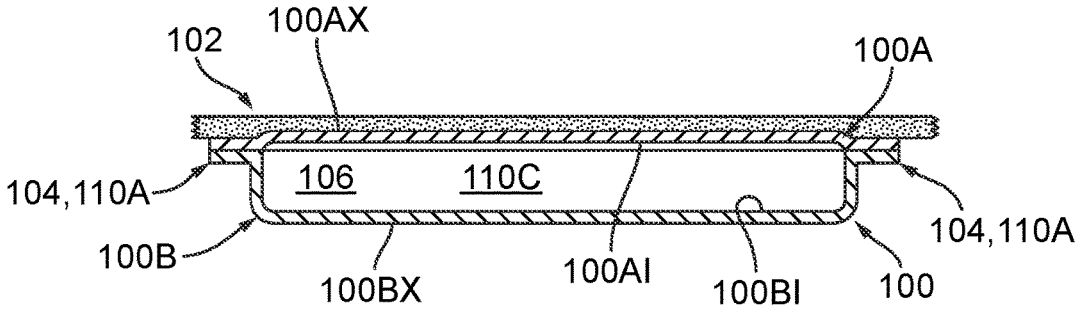

FIGS. 1A-1D illustrate features of bladder systems 100 for articles of footwear 1000 in accordance with some examples of this technology. FIG. 1A provides a side view (e.g., a medial side view) of a footwear upper base component 102 (made from one or more component parts) with which a bladder system 100 in accordance with some examples of this technology is partially engaged. FIGS. 1B and 1C provide a medial side view and a lateral side view, respectively, of an example article of footwear 1000 according to this technology. Alternatively, if desired, the bladder system 100 may be arranged on a footwear upper base component 102 such that FIG. 1B constitutes a lateral side view and FIG. 1C constitutes a medial side view. FIG. 1D provides a cross sectional view along line 1D-1D of FIG. 1A (although features of the bladder system 100 and its connection to a footwear upper component 102 as shown in FIG. 1D also may apply to the other bladder systems and upper components described below in conjunction with FIGS. 2A-4).

As shown in FIG. 1D, the bladder system 100 (and its bladder pods, described in more detail below) comprises a first thermoplastic elastomer sheet 100A (having an interior surface 100AI and an exterior surface 100AX) and a second thermoplastic elastomer sheet 100B (having an interior surface 100BI and an exterior surface 100B X). The two thermoplastic elastomer sheets 100A, 100B are joined together (at interfacing interior surfaces 100AI, 100BI) by a bond 104. The two thermoplastic elastomer sheets 100A, 100B may be joined together in any desired manner, including in manners conventionally known and used in the footwear arts, e.g., via adhesives, via bonding techniques using heat and/or pressure, via melt bonding, via welding techniques (e.g., RF welding, ultrasonic welding, etc.), etc. The exterior surface 100AX of one thermoplastic elastomer sheet 100A is engaged with (e.g., bonded to) the upper base component 102.

An interior chamber 106 is defined between the first thermoplastic elastomer sheet 100A and the second thermoplastic elastomer sheet 100B and inside of the bond 104. Thus, the bond 104 and the thermoplastic elastomer sheets 100A, 100B in this example form a single, continuous, gas-tight (sealed), interior chamber pod 106. While the bond 104 may extend around 100% of the outer perimeter of the bladder system component 100, this is not a requirement. For example, if the first thermoplastic elastomer sheet 100A and the second thermoplastic elastomer sheet 100B constitute portions of a single sheet of thermoplastic elastomer material (e.g., that is folded on at least one edge), the bond 104 could form a sealed bond between overlapping portions of the first thermoplastic elastomer sheet 100A and the second thermoplastic elastomer sheet 100B at locations other than at the fold.

In this illustrated example, also referring back to FIGS. 1A-1C, the upper base component 102 constitutes a high-top upper, e.g., for a basketball shoe. The upper base component 102 may have any desired number of parts, including one or more fabric, textile, plastic, metal, leather, and/or rubber component parts. The upper base component 102 may have conventional constructions and may be made of conventional materials as are known and used in the footwear arts.

FIGS. 1A-1C show the bladder system 100 engaged with the footwear upper base component 102 at the ankle containing area (or heel containing area) of the overall upper base component 102. The bladder system 100 of this example wraps around the rear heel area of the upper base component 102 such that medial side ankle or heel support, lateral side ankle or heel support, and Achilles support are provided. The bladder system 100 of FIGS. 1A-1C does not completely encircle the wearer's foot and/or leg (e.g., the bladder system 100 has a forward medial end or edge 108M (FIG. 1B) and a forward lateral end or edge 108L and does not extend across the front or instep area of the upper base component 102). The bladder system 100 may be engaged with the upper base component 102 in any desired manner. As some more specific examples, the bladder system 100 may be engaged with the upper base component 102 (e.g., to one or more component parts of the upper base component 102) by one or more of: sewing (e.g., sewing through the bond 104 and one or more upper base components 102); bonding techniques (e.g., adhesive free bonding or adhesive based bonding); mechanical connectors or fasteners (e.g., rivets or other connectors extending through the bond 104 and one or more upper base components 102); etc. As other examples, the bladder system 100 (e.g., the thermoplastic elastomer material (e.g., sheet 100A)) may be engaged with one or more fabric components of upper base component 102 by adhesives, by adhesive free bonding, by welding techniques, etc., including in any of the ways described in U.S. Provisional Patent Appln. No. 63/277,916 filed Nov. 10, 2021 and/or described in U.S. Provisional Patent Appln. No. 63/277,932 filed Nov. 10, 2021. Each of U.S. Provisional Patent Appln. No. 63/277,916 and U.S. Provisional Patent Appln. No. 63/277,932 is entirely incorporated herein by reference.

As further shown in FIGS. 1B and 1C, the footwear upper base 102 may be engaged with a footwear sole structure 1004. The sole structure 1004 may have any desired number of parts, including one or more midsole component parts and/or one or more outsole component parts. The sole structure 1004 may have conventional constructions and may be made of conventional materials as are known and used in the footwear arts. Further, the sole structure 1004 may be engaged with one or more upper base component 102 parts, including in conventional manners as are known and used in the footwear arts.

Features of the example bladder system 100 illustrated in FIGS. 1A-1C now will be described in more detail. As shown, this example bladder system 100 includes three bladder pods 110, 120, 130. More or fewer bladder pods could be provided, if desired. The first bladder pod 110 includes a first seam 110A (which may be at least partially formed by an outer perimeter seam 104) that defines a first interior bladder chamber 110C (e.g., filled with fluid, such as a gas). This first bladder pod 110 supports an upper and forward medial ankle region of a wearer's foot (although it also could be located at an upper and forward lateral ankle region of the wearer's foot).

This example bladder system 100 also includes a second bladder pod 120 that includes a second seam 120A (which also may be at least partially formed by outer perimeter seam 104) that defines a second interior bladder chamber 120C (e.g., filled with fluid, such as a gas). This second bladder pod 120 supports a lower (and central) medial ankle region of a wearer's foot (although it also could be located at a lower lateral (and central) ankle region of the wearer's foot). In this illustrated example: (i) the first seam 110A completely surrounds and seals the first interior bladder chamber 110C, (ii) the second seam 120A completely surrounds and seals the second interior bladder chamber 120C, and (iii) the first interior bladder chamber 110C is not in fluid communication with the second interior bladder chamber 120C. Thus, the two pods 110 and 120 are not in fluid communication with one another. Alternatively, if desired, a fluid path between the first interior bladder chamber 110C and the second interior bladder chamber 120C could be provided (e.g., in region 115 shown in FIG. 1A). Thus, in this alternative arrangement, the first interior bladder chamber 110C could be placed in fluid communication with the second interior bladder chamber 120C.

As further shown in FIGS. 1A and 1B, in this illustrated example bladder system 100, a first elastic connector 150 engages the first seam 110A and the second seam 120A and/or the first elastic connector 150 engages the first bladder pod 110 and the second bladder pod 120.

The example of FIGS. 1A-1C further includes a third bladder pod 130. The third bladder pod 130 includes a third seam 130 (which also may be at least partially formed by outer perimeter seam 104) that defines a third interior bladder chamber 130C (e.g., filled with fluid, such as a gas). This third bladder pod 130 supports a rear ankle and/or heel region of a wearer's foot. In this illustrated example, the third seam 130A completely surrounds and seals the third interior bladder chamber 110C. Thus, the third interior bladder chamber 130C is not in fluid communication with the first interior bladder chamber 110C and/or is not in fluid communication with the second interior bladder chamber 120C. Thus, the three pods 110, 120, and 130 are not in fluid communication with one another. Alternatively, if desired, one or more fluid paths may be provided: (a) between the first interior bladder chamber 110C and the second interior bladder chamber 120C (e.g., in region 115 shown in FIG. 1A), (b) between the first interior bladder chamber 110C and the third interior bladder chamber 130C (e.g., in region 125 shown in FIG. 1A), and/or (c) between the second interior bladder chamber 120C and the third interior bladder chamber 130C (e.g., in region 135 shown in FIG. 1A). Thus, in these alternative arrangements, two or more of the first interior bladder chamber 110C, the second interior bladder chamber 120C, and the third interior bladder chamber 130C may be in fluid communication with one another.

In the example of FIGS. 1A-1C, the third bladder pod 130 includes a first pod chamber 132A (e.g., a medial side chamber pod), a second pod chamber 132B (e.g., a lateral side chamber pod), and a fluid passage 132 connecting the first pod chamber 132A and the second pod chamber 132B. Thus, in this illustrated example, the first pod chamber 132A is in fluid communication with the second pod chamber 132B. The fluid passage 132 extends around the rear heel and/or ankle area of the upper base component 102, from the medial side to the lateral side of the upper base component 102. As shown in FIGS. 1A-1C a portion of the first pod chamber 132A and portion of the second pod chamber 132B each extend above the fluid passage 132 in a vertical direction, and a portion of the first pod chamber 132A and portion of the second pod chamber 132B each extend below the fluid passage 132 in a vertical direction. Further, as shown in FIGS. 1A-1C the third bladder pod can have a butterfly shape. Alternatively, if desired, the two pod chambers 132A and 132B could be isolated and not in fluid communication with one another (e.g., fluid passage 132 may be omitted, closed, or sealed).

In the example of FIGS. 1A-1C, the first elastic connector 150 also connects to the third seam 130A of the third pod 130. Thus, each of the first seam 110A, the second seam 120A, and the third seam 130A connect to the first elastic connector 150 and/or in some manner, each of the first bladder pod 110, the second bladder pod 120, and the third bladder pod 130 are connected to the first elastic connector 150.

While other arrangements are possible, in some examples of this technology, the first elastic connector 150 may be sized, shaped, and/or located on the upper base component 102 such that the first elastic connector 150 generally fits over the wearer's medial malleolus or lateral malleolus. The elastic connector 150 may enable the bladder system 100 to fit snugly to the wearer's ankle and/or heel area. The elastic connector 150 also may allow some relative movement between the first bladder pod 110, the second bladder pod 120, and the third bladder pod 130, e.g., as a wearer moves in the article of footwear 1000, while allowing the bladder system 100 to provide support and a snug fit and while being capable of returning to its original size, shape, and/or location once the force from the wearer's movement is removed or sufficiently relaxed.

FIGS. 1A-1C show the first bladder pod 110, the second bladder pod 120, and the third bladder pod 130 as part of a single bladder system 100 component, e.g., joined by a single, continuous outer perimeter seam 104 that extends between and joins the bladder pods 110, 120, 130. Other options are possible. For example, one or more of the first bladder pod 110, the second bladder pod 120, and/or the third bladder pod 130 could be completely separate and independent components from the other bladder pod(s), but these separate and independent components could be engaged together, e.g., by the elastic component 150. In such structures, the elastic component 150 could engage and extend between the seams 110A, 120A, 130A, e.g., in a manner similar to the engagement described below in conjunction with FIG. 2C.

Also, if desired, both the lateral side and the medial side of an upper base component 102 could include multiple bladder pods and/or one or more elastic connectors. As a more specific example, if desired, each side of the article of footwear 1000 could have a three bladder pod construction including first bladder pod 110, second bladder pod 120, first pod chamber 132A, and elastic connector 150 (e.g., appearing similar to the structure shown in FIG. 1B). The first pod chambers 132 on the opposite sides could be in fluid communication (via a fluid passage like fluid passage 132) or they could be in fluid isolation with respect to one another. Both sides could be part of a single bladder system part (e.g., connected by perimeter seam 104). In such structures, the elastic connector 150 on one side may fit over the wearer's medial malleolus and the elastic connector 150 on the other side may fit over the wearer's lateral malleolus. In such structures, the first bladder pods 110 on each side could connect with one another (e.g., by a connector extending around the front ankle area of the upper base component 102) or they may remain separated.

In the structure described above, the elastic connector 150 constitutes a separate component or separate material part from the upper base component 102 to which the bladder system (e.g., the first thermoplastic elastomer sheet 102A) is attached. Alternatively, if desired, elastic connector 150 may constitute a single and continuous part with at least one upper base component 102 part to which the bladder system 100 (e.g., first thermoplastic elastomer sheet 102A) is attached. Thus, in FIGS. 1A and 1B, the area with elastic connector 150 may constitute a through hole or gap located between the first bladder pod 110, the second bladder pod 120, and the first pod chamber 132A, and the material of the elastic connector 150 also may constitute an upper base component 102, which is exposed in the through hole or gap. The bladder system 100 may be engaged with the upper base component 102, which includes the elastic connector 150 portion in this example, e.g., by an adhesive free or adhesive bond, by sewing, etc.

Figure 2A:
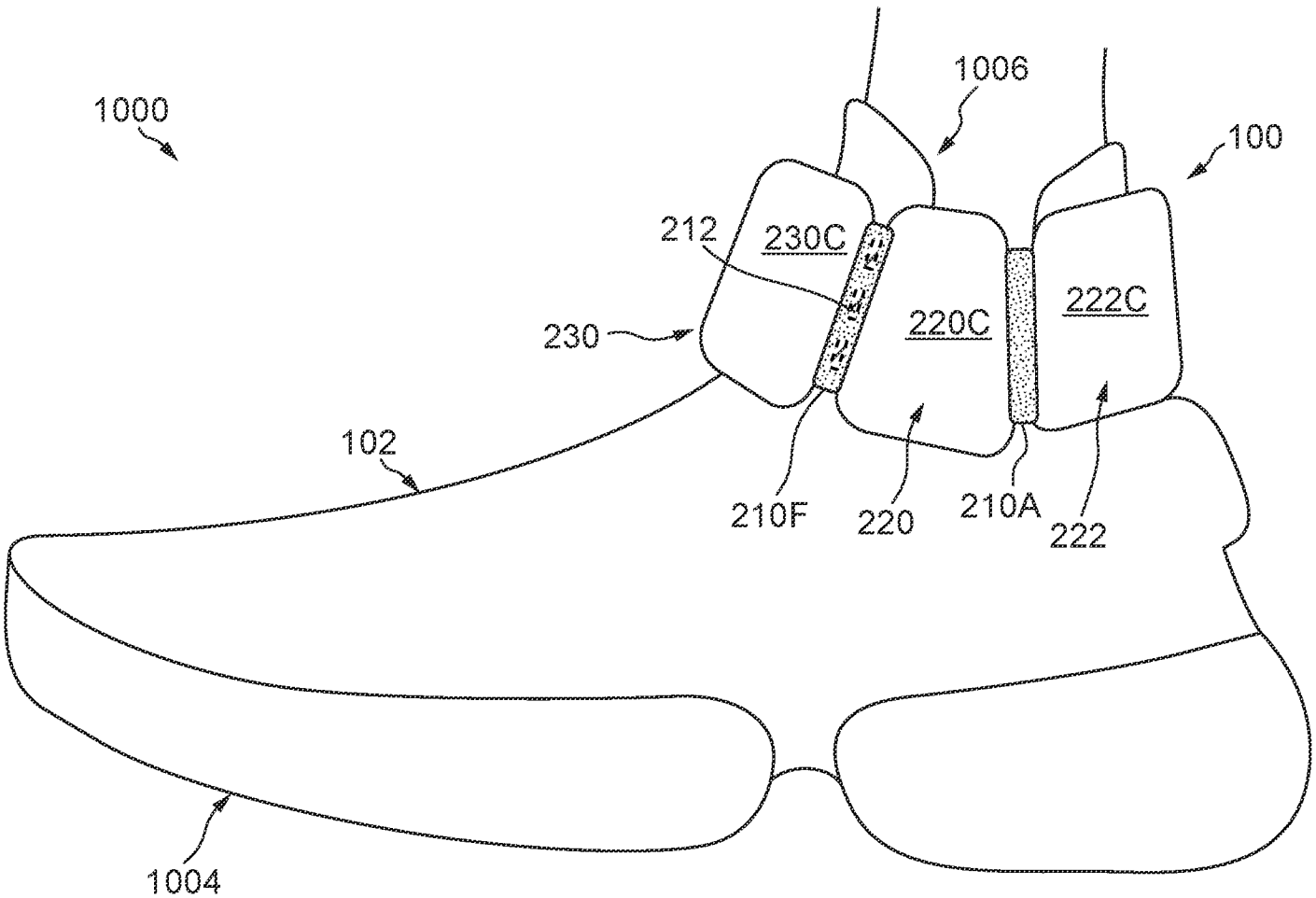
FIGS. 2A-2G provide various views of bladder systems, uppers, and articles of footwear in accordance with additional examples and aspects of this technology.
Figure 2B:
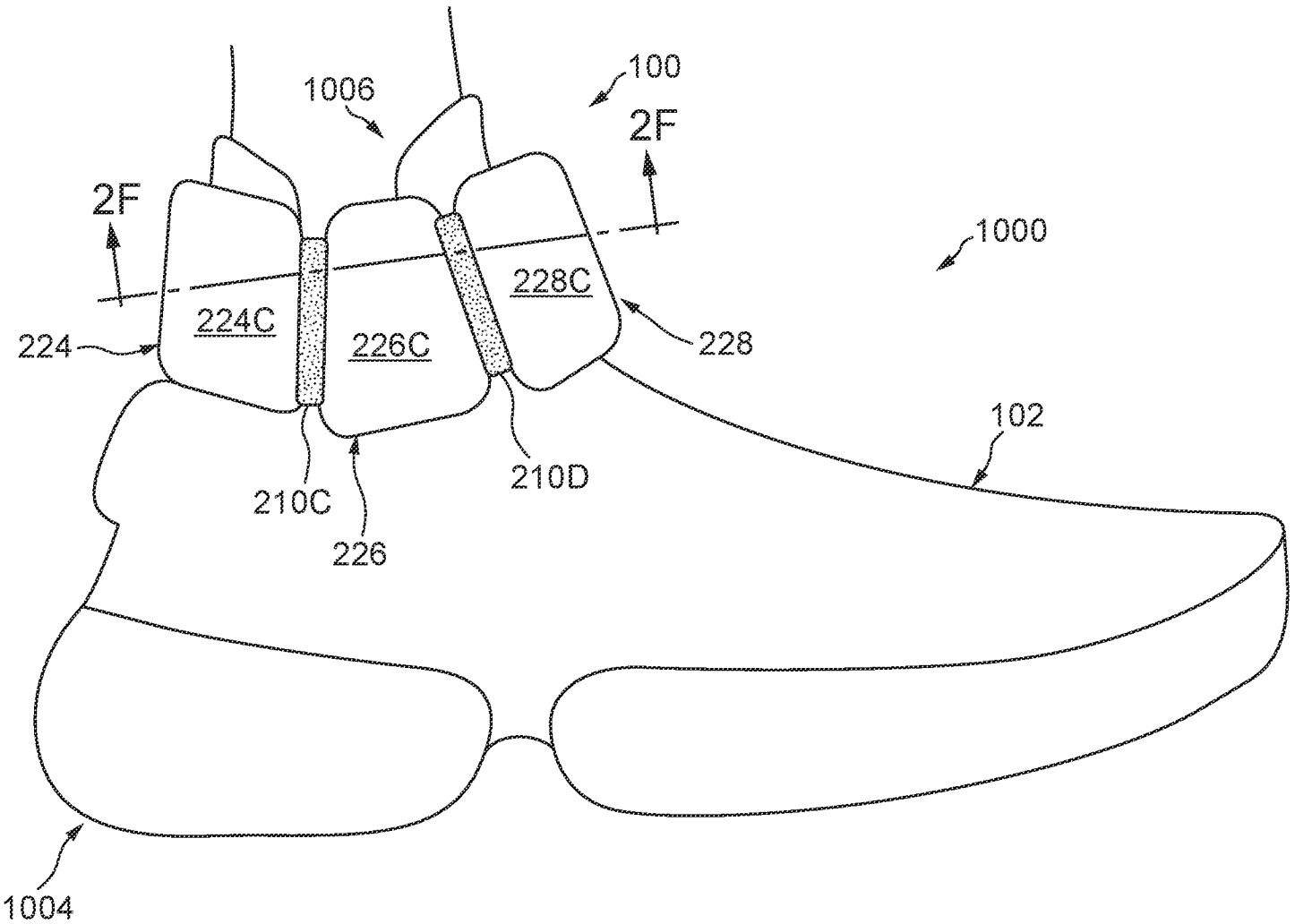
Figure 2C:
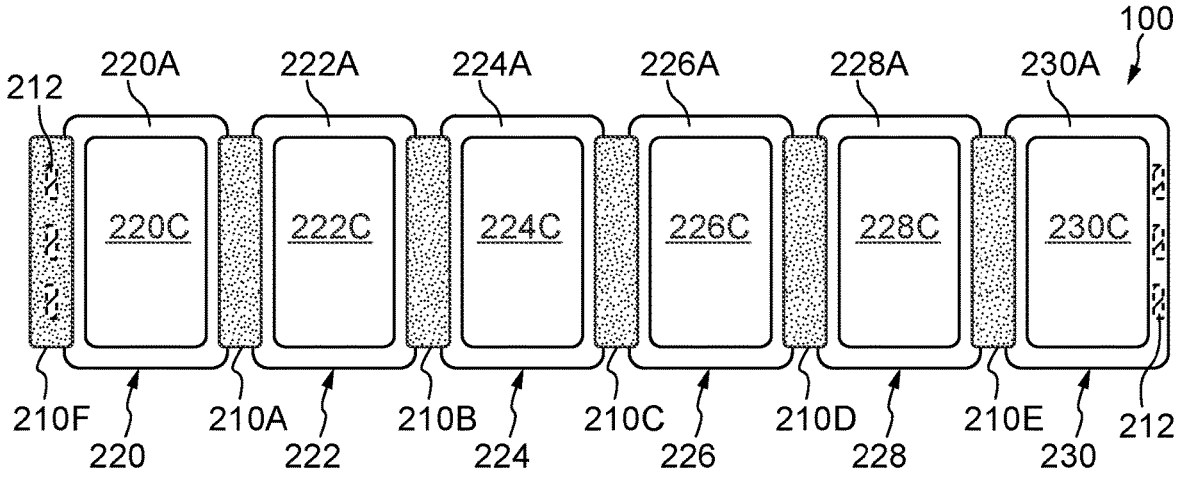
Figure 2D:
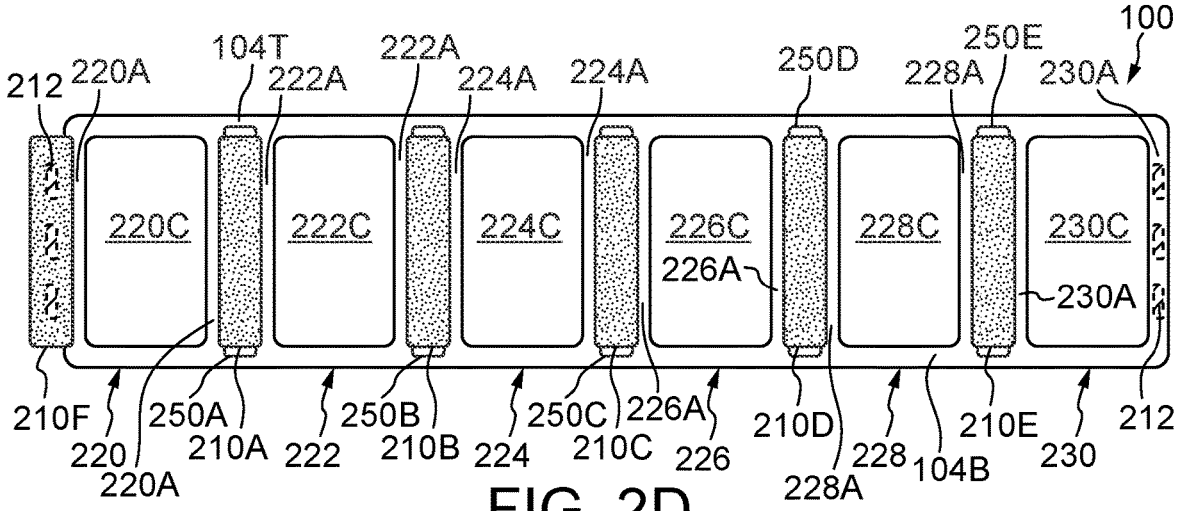
Figure 2E:
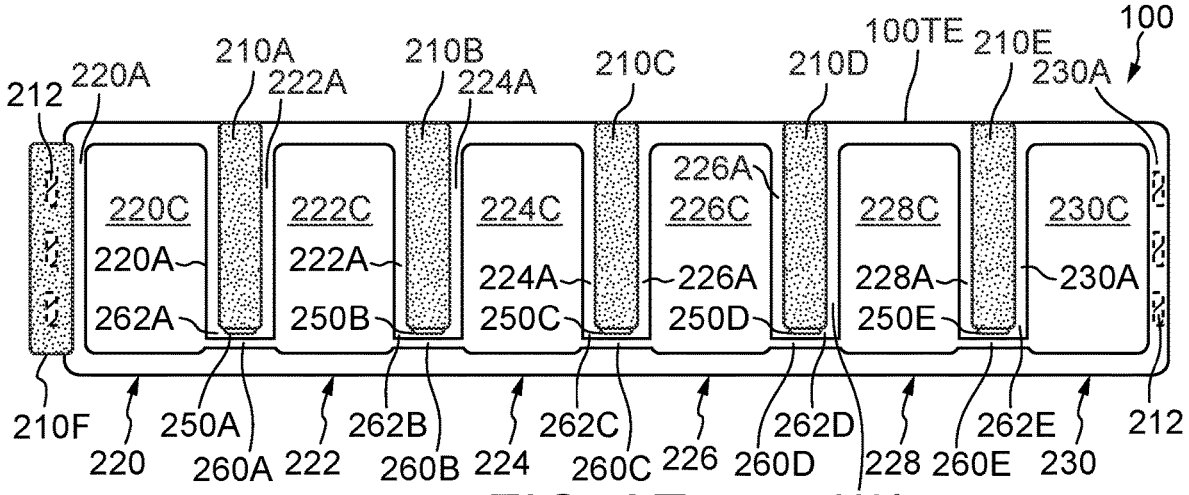
Figure 2F:
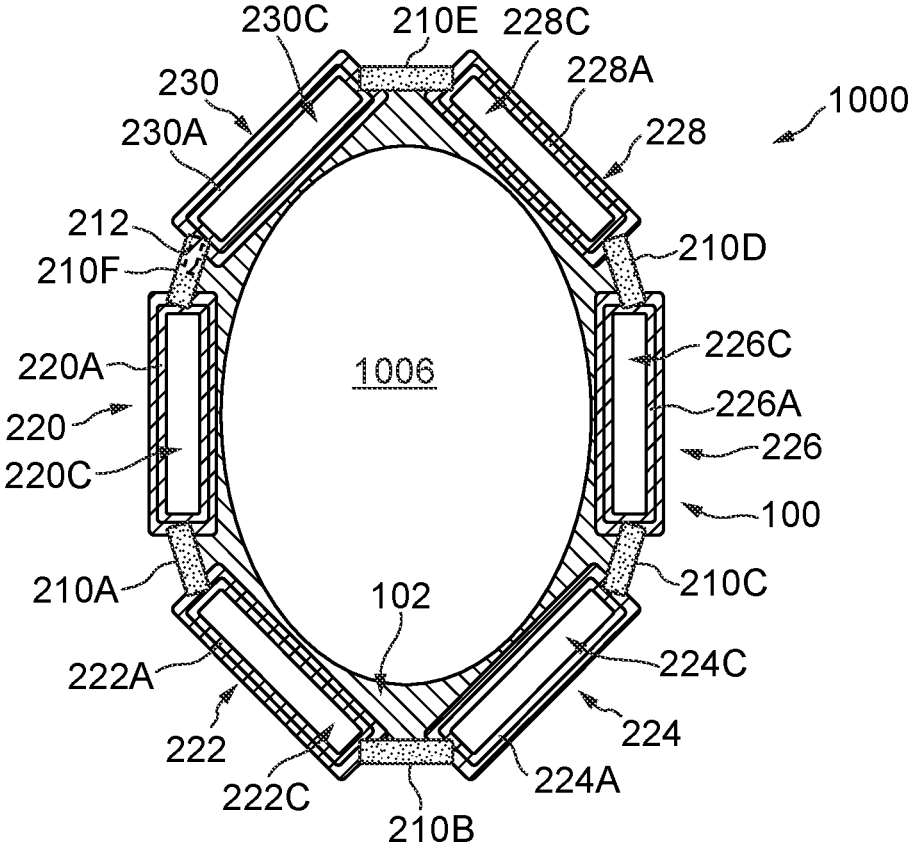
Figure 2G:
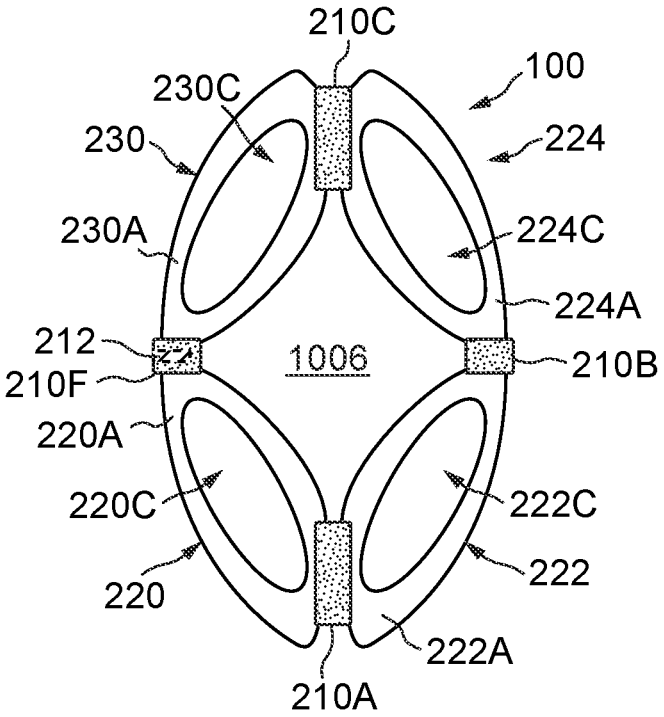

FIGS. 2A-2G provide various views of bladder systems 100, footwear uppers, and articles of footwear 1000 in accordance with other examples of this technology. FIGS. 2A and 2B provide medial and lateral side views, respectively, of an article of footwear 1000 and bladder system 100 in accordance with one example of the present technology. FIGS. 2C-2E provide views of various example bladder systems 100 that may be used in such articles of footwear 1000, e.g., with various different connection structures between bladder pods. FIG. 2F provides a cross sectional view of the article of footwear 1000 through line 2F-2F in FIG. 2B. FIG. 2G provides a cross sectional view of an alternative bladder system structure. Where the same reference numbers are used in FIGS. 2A-2G as used in FIGS. 1A-1D, the same or similar parts are being referenced (e.g., with any of the options or alternatives described above), and much of the overlapping disclosure may be omitted. In the examples of FIGS. 2A-2G, the bladder systems 100 are positioned with respect to the upper base component 102 and configured to form a support sleeve that completely encircles the wearer's ankle. Further, the bladder systems 100 of FIGS. 2A-2G will completely surround foot insertion opening 1006 of the article of footwear 1000.

In the example of FIGS. 2A-2C and 2F, the bladder system 100 includes six separate bladder pod components (220, 222, 224, 226, 228, 230) that are joined together by connectors (210A-210F). One or more of these connectors (210A-210F)—and optionally all of them—may be formed from or include an elastic material. At least one of these connectors (e.g., connector 210F) may include a releasable fastener system 212, e.g., to enable the ends of the bladder system 100 to be engaged together and separated (e.g., to more easily allow insertion and removal of a wearer's foot). When present, the releasable fastener 212 and the connector 210F on which it may be provided may be located at any position around the bladder system 100. In this illustrated example, that releasable fastener 212 and connector 210F are provided at the forward medial ankle support area of the bladder system 100 and the upper base component 102. The releasable fastener 212 may include any desired type of structure, such as one or more of: a hook-and-loop fastener, a strap system, a buckle, a button, a snap, a hook, a clasp, a magnetic fastener, etc. Alternatively, if desired, a releasable fastener system may be omitted and the bladder system 100 may be fixed in a circular arrangement as shown in FIGS. 2A and 2B (e.g., with the first bladder pod 220 connected to the sixth bladder pod 230). In such structures, the elastic connector(s) may provide sufficient stretchability to enable insertion and removal of a wearer's foot.

The bladder system 100 of FIGS. 2A-2C and 2F includes: (i) a first bladder pod 220 including a first seam 220A that defines a first interior bladder chamber 220C (e.g., filled with fluid, such as a gas); and (ii) a second bladder pod 222 including a second seam 222A that defines a second interior bladder chamber 222C (e.g., filled with fluid, such as a gas). A first connector 210A engages the first seam 220A and the second seam 222A. In at least some examples of this technology, this first connector 210A may include or be formed from an elastic material (and thereby form an elastic connector engaging the first seam 220A and the second seam 222A). First connector 210A, however, need not be an elastic connector (e.g., if one or more of the other connectors in the bladder system 100 is/are an elastic connector). In this illustrated example, as shown in FIG. 2A, the first bladder pod 220 is located in (and/or engaged with the upper base component 102 at) a mid-medial ankle area of the upper base component 102 and article of footwear 1000, and the second bladder pod 222 is located in (and/or engaged with the upper base component 102 at) a rear-medial ankle area of the upper base component 102 and article of footwear 1000.

In the structure shown in FIG. 2C: (i) the first seam 220A completely surrounds and seals the first interior bladder chamber 220C, and (ii) the second seam 222A completely surrounds and seals the second interior bladder chamber 222C. Thus, in this example, the first interior bladder chamber 220C is not in fluid communication with the second interior bladder chamber 222C.

This example bladder system 100 further includes a third bladder pod 224, e.g., as a separate component from the first bladder pod 220 and the second bladder pod 222. The third bladder pod 224 includes a third seam 224A that defines a third interior bladder chamber 224C (e.g., filled with fluid, such as a gas). A second connector 210B engages the second seam 222A and the third seam 224A. In at least some examples of this technology, this second connector 210B may include or be formed from an elastic material (and thereby form an elastic connector engaging the second seam 222A and the third seam 224A). Second connector 210B, however, need not be an elastic connector (e.g., if one or more of the other connectors in the bladder system 100 is/are an elastic connector). Also, in this illustrated example of FIG. 2C, the third seam 224A completely surrounds and seals the third interior bladder chamber 224C. Thus, in the example of FIG. 2C, the first interior bladder chamber 220C, the second interior bladder chamber 222C, and the third interior bladder chamber 224C are not in fluid communication with one another. In this illustrated example, as shown in FIG. 2B, the third bladder pod 224 is located in (and/or engaged with the upper base component 102 at) a rear-lateral ankle area of the upper base component 102 and article of footwear 1000.

The example bladder system 100 of FIG. 2C further includes a fourth bladder pod 226, e.g., as a separate component from the first bladder pod 220, the second bladder pod 222, and the third bladder pod 224. The fourth bladder pod 226 includes a fourth seam 226A that defines a fourth interior bladder chamber 226C (e.g., filled with fluid, such as a gas). A third connector 210C engages the third seam 224A and the fourth seam 226A. In at least some examples of this technology, this third connector 210C may include or be formed from an elastic material (and thereby form an elastic connector engaging the third seam 224A and the fourth seam 226A). Third connector 210C, however, need not be an elastic connector (e.g., if one or more of the other connectors in the bladder system 100 is/are an elastic connector). Also, in this illustrated example of FIG. 2C, the fourth seam 226A completely surrounds and seals the fourth interior bladder chamber 226C. Thus, in the example of FIG. 2C, the first interior bladder chamber 220C, the second interior bladder chamber 222C, the third interior bladder chamber 224C, and the fourth interior bladder chamber 226C are not in fluid communication with one another. In this illustrated example, as shown in FIG. 2B, the fourth bladder pod 226 is located in (and/or engaged with the upper base component 102 at) a mid-lateral ankle area of the upper base component 102 and article of footwear 1000.

FIG. 2C further shows that this example bladder system 100 includes a fifth bladder pod 228, e.g., as a separate component from the first bladder pod 220, the second bladder pod 222, the third bladder pod 224, and the fourth bladder pod 226. The fifth bladder pod 228 includes a fifth seam 228A that defines a fifth interior bladder chamber 228C (e.g., filled with fluid, such as a gas). A fourth connector 210D engages the fourth seam 226A and the fifth seam 228A. In at least some examples of this technology, this fourth connector 210D may include or be formed from an elastic material (and thereby form an elastic connector engaging the fourth seam 226A and the fifth seam 228A). Fourth connector 210D, however, need not be an elastic connector (e.g., if one or more of the other connectors in the bladder system 100 is/are an elastic connector). Also, in this illustrated example of FIG. 2C, the fifth seam 228A completely surrounds and seals the fifth interior bladder chamber 228C. Thus, in the example of FIG. 2C, the first interior bladder chamber 220C, the second interior bladder chamber 222C, the third interior bladder chamber 224C, the fourth interior bladder chamber 226C, and the fifth interior bladder chamber 228C are not in fluid communication with one another. In this illustrated example, as shown in FIG. 2B, the fifth bladder pod 228 is located in (and/or engaged with the upper base component 102 at) a forward-lateral ankle area of the upper base component 102 and article of footwear 1000.

The example bladder system 100 of FIG. 2C further includes a sixth bladder pod 230, e.g., as a separate component from the first bladder pod 220, the second bladder pod 222, the third bladder pod 224, the fourth bladder pod 226, and the fifth bladder pod 228. The sixth bladder pod 230 includes a sixth seam 230A that defines a sixth interior bladder chamber 230C (e.g., filled with fluid, such as a gas). A fifth connector 210E engages the fifth seam 228A and the sixth seam 230A. In at least some examples of this technology, this fifth connector 210E may include or be formed from an elastic material (and thereby form an elastic connector engaging the fifth seam 228A and the sixth seam 230A). Fifth connector 210E, however, need not be an elastic connector (e.g., if one or more of the other connectors in the bladder system 100 is/are an elastic connector). Also, in this illustrated example of FIG. 2C, the sixth seam 230A completely surrounds and seals the sixth interior bladder chamber 230C. Thus, in the example of FIG. 2C, the first interior bladder chamber 220C, the second interior bladder chamber 222C, the third interior bladder chamber 224C, the fourth interior bladder chamber 226C, the fifth interior bladder chamber 228C, and the sixth interior bladder chamber 230C are not in fluid communication with one another. In this illustrated example, as shown in FIG. 2A, the sixth bladder pod 230 is located in (and/or engaged with the upper base component 102 at) a forward-medial ankle area of the upper base component 102 and article of footwear 1000.

FIG. 2C further shows that the sixth bladder pod 230 of this example includes part of the releasable fastener system 212, e.g., to enable the sixth bladder pod 230 to be engaged with the first bladder pod 220. While other options are possible, in this illustrated example, portions of the fastener system 212 may be provided on the seam 230A of the sixth bladder pod 230. These fastener system 212 portions on the sixth seam 230A may engage (e.g., mate with or otherwise engage) the portion(s) of the fastener system 212 provided on the sixth connector 210F. As another option, the fastener system 212 portions on the sixth seam 230A may comprise one or more openings in the sixth seam 230 that engage the sixth connector 210F and/or portions of the fastener system 212 on the sixth connector 210F. The releasable fastener system 212 may include any desired type of structure, such as one or more of: a hook-and-loop fastener, a strap system, a buckle, a button, a snap, a hook, a clasp, a magnetic fastener, etc.

In the bladder system 100 of FIG. 2C, the bladder pods 220, 222, 224, 226, 228, 230 are separate and individual components that are engaged together by connectors 210A, 210B, 210C, 210D, 210E, 210F and fastener system 212. In this structure, one or more of the following may be present: (i) the first connector 210A (which may be an elastic connector) is the only structural element extending between and/or connecting the first bladder pod 220 and the second bladder pod 222, (ii) the second connector 210B (which may be an elastic connector) is the only structural element extending between and/or connecting the second bladder pod 222 and the third bladder pod 224, (iii) the third connector 210C (which may be an elastic connector) is the only structural element extending between and/or connecting the third bladder pod 224 and the fourth bladder pod 226, (iv) the fourth connector 210D (which may be an elastic connector) is the only structural element extending between and/or connecting the fourth bladder pod 226 and the fifth bladder pod 228, (v) the fifth connector 210E (which may be an elastic connector) is the only structural element extending between and/or connecting the fifth bladder pod 228 and the sixth bladder pod 230, and/or (vi) the sixth connector 210F (which may be an elastic connector) is the only structural element extending between and/or connecting the sixth bladder pod 230 and the first bladder pod 220. Thus, at least some bladder systems 100 in accordance with aspects of this technology may consist only of (or consist essentially of) the bladder pods 220-230, the connectors 210A-210F, and (if present) a fastening system 212.

FIG. 2D shows an alternative bladder system 100 that may be used in footwear products, e.g., of the types illustrated in FIGS. 2A and 2B. The bladder system 100 of FIG. 2D differs from that shown in FIG. 2C, in at least one aspect, based on the unitary or co-joined nature of the structure shown in FIG. 2D. More specifically, in the example of FIG. 2C, the bladder pods 220-230 are independent and separate components that are engaged together by connectors 210A-210F. In the bladder system 100 of FIG. 2D, on the other hand, two or more of the bladder pods 220-230 are interconnected with one another, e.g., by one or more "joining seams" portions. In the example of FIG. 2D, a top joining seam 104T extends between and connects two or more of the bladder pods 220-230 and a bottom joining seam 104B extends between and connects two or more of the bladder pods 220-230. The top joining seam 104T and the bottom joining seam 104B also may constitute part of the seams that define the bladder chambers 220C-230C.

In the examples of FIGS. 2A, 2B, and 2D, the bladder system 100 includes six separate bladder pod components (220, 222, 224, 226, 228, 230) that are joined together by: (i) connectors (210A-210F), (ii) by top joining seam 104T, and (iii) by bottom joining seam 104B. One or more of the connectors (210A-210F)—and optionally all of them—may be formed from or include an elastic material. At least one of these connectors (e.g., connector 210F) may include a releasable fastener system 212, e.g., to enable the ends of the bladder system 100 to be engaged together and separated (e.g., to more easily allow insertion and removal of a wearer's foot). When present, the releasable fastener 212 and the connector 210F on which it may be provided may be located at any position around the bladder system 100. In this illustrated example, that releasable fastener 212 and connector 210F are provided at the forward medial ankle support area of the bladder system 100 and the upper base component 102. The releasable fastener 212 may include any desired type of structure, such as one or more of: a hook-and-loop fastener, a strap system, a buckle, a button, a snap, a hook, a magnetic fastener, etc.

The bladder system 100 of FIGS. 2A, 2B, and 2D includes: (i) a first bladder pod 220 including a first seam 220A that defines a first interior bladder chamber 220C (e.g., filled with fluid, such as a gas); and (ii) a second bladder pod 222 including a second seam 222A that defines a second interior bladder chamber 222C (e.g., filled with fluid, such as a gas). First seam 220A and second seam 222A may be considered opposite sides of a single seam that extends between and separates the first bladder pod 220 and the second bladder pod 222. A first connector 210A, the top joining seam 104T, and the bottom joining seam 104B engage the first seam 220A and the second seam 222A. In at least some examples of this technology, this first connector 210A may include or be formed from an elastic material (and thereby form an elastic connector engaging the first seam 220A and the second seam 222A). First connector 210A, however, need not be an elastic connector (e.g., if one or more of the other connectors in the bladder system 100 is/are an elastic connector). The first connector 210A may be mounted across an opening 250A defined through the seam that extends between and separates the first bladder pod 220 from the second bladder pod 222. Thus, the opening 250A separates the first seam 220A from the second seam 222A between the first bladder pod 220 and the second bladder pod 222. Such an opening 250A, when present, may allow more relative movement between the first bladder pod 220 and the second bladder pod 222 (e.g., as the wearer moves within the article of footwear 1000). In this illustrated example, as shown in FIG. 2A, the first bladder pod 220 is located in (and/or engaged with the upper base component 102 at) a mid-medial ankle area of the upper base component 102 and article of footwear 1000, and the second bladder pod 222 is located in (and/or engaged with the upper base component 102 at) a rear-medial ankle area of the upper base component 102 and article of footwear 1000.

In the structure shown in FIG. 2D: (i) the first interior bladder chamber 220C is completely surrounded and sealed by seams 220A, 104T, and 104B, and (ii) the second interior bladder chamber 222C is completely surrounded and sealed by seams 222A, 104T, and 104B. Thus, in this example, the first interior bladder chamber 220C is not in fluid communication with the second interior bladder chamber 222C.

The bladder system 100 of FIGS. 2A, 2B, and 2D further includes a third bladder pod 224 including a third seam 224A that defines a third interior bladder chamber 224C (e.g., filled with fluid, such as a gas). Second seam 222A and third seam 224A may be considered opposite sides of a single seam that extends between and separates the second bladder pod 222 and the third bladder pod 224. A second connector 210B, the top joining seam 104T, and the bottom joining seam 104B engage the second seam 222A and the third seam 224A. In at least some examples of this technology, this second connector 210B may include or be formed from an elastic material (and thereby form an elastic connector engaging the second seam 222A and the third seam 224A). Second connector 210B, however, need not be an elastic connector (e.g., if one or more of the other connectors in the bladder system 100 is/are an elastic connector). The second connector 210B may be mounted across an opening 250B defined through the seam that extends between and separates the second bladder pod 222 from the third bladder pod 224. Thus, the opening 250B separates the second seam 222A from the third seam 224A between the second bladder pod 222 and the third bladder pod 224. Such an opening 250B, when present, may allow more relative movement between the second bladder pod 222 and the third bladder pod 224 (e.g., as the wearer moves within the article of footwear 1000). In this illustrated example, as shown in FIG. 2B, the third bladder pod 224 is located in (and/or engaged with the upper base component 102 at) a rear-lateral ankle area of the upper base component 102 and article of footwear 1000. Also, in the structure shown in FIG. 2D, the third interior bladder chamber 224C is completely surrounded and sealed by seams 224A, 104T, and 104B. Thus, in this example, the first interior bladder chamber 220C, the second interior bladder chamber 222C, and the third interior bladder chamber 224C are not in fluid communication with one another.

FIGS. 2A, 2B, and 2D further show that this bladder system 100 includes a fourth bladder pod 226 including a fourth seam 226A that defines a fourth interior bladder chamber 226C (e.g., filled with fluid, such as a gas). Third seam 224A and fourth seam 226A may be considered opposite sides of a single seam that extends between and separates the third bladder pod 224 and the fourth bladder pod 226. A third connector 210C, the top joining seam 104T, and the bottom joining seam 104B engage the third seam 224A and the fourth seam 226A. In at least some examples of this technology, this third connector 210C may include or be formed from an elastic material (and thereby form an elastic connector engaging the third seam 224A and the fourth seam 226A). Third connector 210C, however, need not be an elastic connector (e.g., if one or more of the other connectors in the bladder system 100 is/are an elastic connector). The third connector 210C may be mounted across an opening 250C defined through the seam that extends between and separates the third bladder pod 224 from the fourth bladder pod 226. Thus, the opening 250C separates the third seam 224A from the fourth seam 226A between the third bladder pod 224 and the fourth bladder pod 226. Such an opening 250C, when present, may allow more relative movement between the third bladder pod 224 and the fourth bladder pod 226 (e.g., as the wearer moves within the article of footwear 1000). In this illustrated example, as shown in FIG. 2B, the fourth bladder pod 226 is located in (and/or engaged with the upper base component 102 at) a mid-lateral ankle area of the upper base component 102 and article of footwear 1000. Also, in the structure shown in FIG. 2D, the fourth interior bladder chamber 226C is completely surrounded and sealed by seams 226A, 104T, and 104B. Thus, in this example, the first interior bladder chamber 220C, the second interior bladder chamber 222C, the third interior bladder chamber 224C, and the fourth interior bladder chamber 226C are not in fluid communication with one another.

The bladder system 100 shown in FIGS. 2A, 2B, and 2D further includes a fifth bladder pod 228 including a fifth seam 228A that defines a fifth interior bladder chamber 228C (e.g., filled with fluid, such as a gas). Fourth seam 226A and fifth seam 228A may be considered opposite sides of a single seam that extends between and separates the fourth bladder pod 226 and the fifth bladder pod 228. A fourth connector 210D, the top joining seam 104T, and the bottom joining seam 104B engage the fourth seam 226A and the fifth seam 228A. In at least some examples of this technology, this fourth connector 210D may include or be formed from an elastic material (and thereby form an elastic connector engaging the fourth seam 226A and the fifth seam 228A). Fourth connector 210D, however, need not be an elastic connector (e.g., if one or more of the other connectors in the bladder system 100 is/are an elastic connector). The fourth connector 210D may be mounted across an opening 250D defined through the seam that extends between and separates the fourth bladder pod 226 from the fifth bladder pod 228. Thus, the opening 250D separates the fourth seam 226A from the fifth seam 228A between the fourth bladder pod 226 and the fifth bladder pod 228. Such an opening 250D, when present, may allow more relative movement between the fourth bladder pod 226 and the fifth bladder pod 228 (e.g., as the wearer moves within the article of footwear 1000). In this illustrated example, as shown in FIG. 2B, the fifth bladder pod 228 is located in (and/or engaged with the upper base component 102 at) a forward-lateral ankle area of the upper base component 102 and article of footwear 1000. Also, in the structure shown in FIG. 2D, the fifth interior bladder chamber 228C is completely surrounded and sealed by seams 228A, 104T, and 104B. Thus, in this example, the first interior bladder chamber 220C, the second interior bladder chamber 222C, the third interior bladder chamber 224C, the fourth interior bladder chamber 226C, and the fifth interior bladder chamber 228C are not in fluid communication with one another.

The bladder system 100 shown in FIGS. 2A, 2B, and 2D further includes a sixth bladder pod 230 including a sixth seam 230A that defines a sixth interior bladder chamber 230C (e.g., filled with fluid, such as a gas). Fifth seam 228A and sixth seam 230A may be considered opposite sides of a single seam that extends between and separates the fifth bladder pod 228 and the sixth bladder pod 230. A fifth connector 210E, the top joining seam 104T, and the bottom joining seam 104B engage the fifth seam 228A and the sixth seam 230A. In at least some examples of this technology, this fifth connector 210E may include or be formed from an elastic material (and thereby form an elastic connector engaging the fifth seam 228A and the sixth seam 230A). Fifth connector 210E, however, need not be an elastic connector (e.g., if one or more of the other connectors in the bladder system 100 is/are an elastic connector). The fifth connector 210E may be mounted across an opening 250E defined through the seam that extends between and separates the fifth bladder pod 228 from the sixth bladder pod 230. Thus, the opening 250E separates the fifth seam 228A from the sixth seam 230A between the fifth bladder pod 228 and the sixth bladder pod 230. Such an opening 250E, when present, may allow more relative movement between the fifth bladder pod 228 and the sixth bladder pod 230 (e.g., as the wearer moves within the article of footwear 1000). In this illustrated example, as shown in FIG. 2A, the sixth bladder pod 230 is located in (and/or engaged with the upper base component 102 at) a forward-medial ankle area of the upper base component 102 and article of footwear 1000. Also, in the structure shown in FIG. 2D, the sixth interior bladder chamber 230C is completely surrounded and sealed by seams 230A, 104T, and 104B. Thus, in this example, the first interior bladder chamber 220C, the second interior bladder chamber 222C, the third interior bladder chamber 224C, the fourth interior bladder chamber 226C, the fifth interior bladder chamber 228C, and the sixth interior bladder chamber 230C are not in fluid communication with one another.

FIG. 2D further shows that a sixth connector 210F and the sixth bladder pod 230 of this example include parts of the releasable fastener system 212, e.g., to enable the sixth bladder pod 230 to be engaged with the first bladder pod 220. The releasable fastener system 212 of FIG. 2D may have any of the features or options for the fastener system 212 described above in conjunction with FIG. 2C. Alternatively, if desired, a releasable fastener system may be omitted and the bladder system 100 of FIG. 2D may be fixed in a circular arrangement as shown in FIGS. 2A and 2B (e.g., with the first bladder pod 220 connected to the sixth bladder pod 230).

While FIG. 2D shows top joining seam 104T and bottom joining seam 104B each extending the full length of the bladder system 100, this is not a requirement. For example, the top joining seam 104T could be completely omitted. Alternatively, the bottom joining seam 104B could be completely omitted. As another alternative, one or more top joining seams 104T could join two or more pods and/or one or more bottom joining seams 104B could join two or more other pods. Thus, in such structures, one or more of openings 250A-250E could extend all the way to the top edge of the bladder system 100 and/or all the way to the bottom edge of the bladder system 100.

In the bladder systems 100 of FIGS. 2C and 2D, the individual bladder pods 220-230 are not in fluid communication with one another. Rather, the pods 220-230 are either completely individual components (FIG. 2C) or in fluid isolation from one another by a seam (e.g., seams 104, 104T, 104B, 220A, 222A, 224A, 226A, 228A, 230A). Other structures and arrangements of bladder pods are possible in some examples of this technology. For example, individual bladder pods like those in FIG. 2C could be used in combination with (and connected via connectors like 210A-210F) two or more interconnected bladder pods of the types shown in FIG. 2D in a single bladder system and/or footwear structure.

Also, while FIGS. 2C and 2D show all bladder pods in fluid isolation from one another, other structures are possible. For example, FIG. 2E illustrates a bladder system 100 similar to those shown in FIGS. 2C and 2D, but the bladder chamber defining seams are shaped so as to form fluid channels between adjacent bladder pods.

The bladder system 100 of FIGS. 2A, 2B, and 2E includes: (i) a first bladder pod 220 including a first seam 220A that defines a first interior bladder chamber 220C (e.g., filled with fluid, such as a gas); and (ii) a second bladder pod 222 including a second seam 222A that defines a second interior bladder chamber 222C (e.g., filled with fluid, such as a gas). A first fluid channel 260A extends between and connects the first interior bladder chamber 220C with the second interior bladder chamber 222C and thus places the first interior bladder chamber 220C in fluid communication with the second interior bladder chamber 222C. In this illustrated example, a first joining seam portion 262A extends between and connects the first seam 220A and the second seam 222A (e.g., the first joining seam portion 262A may be located above and/or below the first fluid channel 260A).

A first connector 210A and the first joining seam portion 262A engage the first seam 220A and the second seam 222A. In at least some examples of this technology, this first connector 210A may include or be formed from an elastic material (and thereby form an elastic connector engaging the first seam 220A and the second seam 222A). First connector 210A, however, need not be an elastic connector (e.g., if one or more of the other connectors in the bladder system 100 is/are an elastic connector). The first connector 210A may be mounted across an opening 250A that extends between and separates the first bladder pod 220 from the second bladder pod 222. In this illustrated example, the first connector 210A (and the first opening 250A) extend upward to the top edge 100TE of the bladder system 100. Such an opening 250A, when present, may allow more relative movement between the first bladder pod 220 and the second bladder pod 222 (e.g., as the wearer moves within the article of footwear 1000).

The bladder system 100 of FIGS. 2A, 2B, and 2E further includes a third bladder pod 224 including a third seam 224A that defines a third interior bladder chamber 224C (e.g., filled with fluid, such as a gas). A second fluid channel 260B extends between and connects the second interior bladder chamber 222C with the third interior bladder chamber 224C and thus places the second interior bladder chamber 222C in fluid communication with the third interior bladder chamber 224C. In this illustrated example, a second joining seam portion 262B extends between and connects the second seam 222A and the third seam 224A (e.g., the second joining seam portion 262B may be located above and/or below the second fluid channel 260B).

Also, a second connector 210B and the second joining seam portion 262B engage the second seam 222A and the third seam 224A. In at least some examples of this technology, this second connector 210B may include or be formed from an elastic material (and thereby form an elastic connector engaging the second seam 222A and the third seam 224A). Second connector 210B, however, need not be an elastic connector (e.g., if one or more of the other connectors in the bladder system 100 is/are an elastic connector). The second connector 210B may be mounted across an opening 250B that extends between and separates the second bladder pod 222 from the third bladder pod 224. In this illustrated example, the second connector 210B (and the second opening 250B) extend upward to the top edge 100TE of the bladder system 100. Such an opening 250B, when present, may allow more relative movement between the second bladder pod 222 and the third bladder pod 224 (e.g., as the wearer moves within the article of footwear 1000).

The bladder system 100 of FIGS. 2A, 2B, and 2E further includes a fourth bladder pod 226 including a fourth seam 226A that defines a fourth interior bladder chamber 226C (e.g., filled with fluid, such as a gas). A third fluid channel 260C extends between and connects the third interior bladder chamber 224C with the fourth interior bladder chamber 226C and thus places the third interior bladder chamber 224C in fluid communication with the fourth interior bladder chamber 226C. In this illustrated example, a third joining seam portion 262C extends between and connects the third seam 224A and the fourth seam 226A (e.g., the third joining seam portion 262C may be located above and/or below the third fluid channel 260C).

Also, a third connector 210C and the third joining seam portion 262C engage the third seam 224A and the fourth seam 226A. In at least some examples of this technology, this third connector 210C may include or be formed from an elastic material (and thereby form an elastic connector engaging the third seam 224A and the fourth seam 226A). Third connector 210C, however, need not be an elastic connector (e.g., if one or more of the other connectors in the bladder system 100 is/are an elastic connector). The third connector 210C may be mounted across an opening 250C that extends between and separates the third bladder pod 224 from the fourth bladder pod 226. In this illustrated example, the third connector 210C (and the third opening 250C) extend upward to the top edge 100TE of the bladder system 100. Such an opening 250C, when present, may allow more relative movement between the third bladder pod 224 and the fourth bladder pod 226 (e.g., as the wearer moves within the article of footwear 1000).

The bladder system 100 of FIGS. 2A, 2B, and 2E further includes a fifth bladder pod 228 including a fifth seam 228A that defines a fifth interior bladder chamber 228C (e.g., filled with fluid, such as a gas). A fourth fluid channel 260D extends between and connects the fourth interior bladder chamber 226C with the fifth interior bladder chamber 228C and thus places the fourth interior bladder chamber 226C in fluid communication with the fifth interior bladder chamber 228C. In this illustrated example, a fourth joining seam portion 262D extends between and connects the fourth seam 226A and the fifth seam 228A (e.g., the fourth joining seam portion 262D may be located above and/or below the fourth fluid channel 260D).

Also, a fourth connector 210D and the fourth joining seam portion 262D engage the fourth seam 226A and the fifth seam 228A. In at least some examples of this technology, this fourth connector 210D may include or be formed from an elastic material (and thereby form an elastic connector engaging the fourth seam 226A and the fifth seam 228A). Fourth connector 210D, however, need not be an elastic connector (e.g., if one or more of the other connectors in the bladder system 100 is/are an elastic connector). The fourth connector 210D may be mounted across an opening 250D that extends between and separates the fourth bladder pod 226 from the fifth bladder pod 228. In this illustrated example, the fourth connector 210D (and the fourth opening 250D) extend upward to the top edge 100TE of the bladder system 100. Such an opening 250D, when present, may allow more relative movement between the fourth bladder pod 226 and the fifth bladder pod 228 (e.g., as the wearer moves within the article of footwear 1000).

The bladder system 100 of FIGS. 2A, 2B, and 2E further includes a sixth bladder pod 230 including a sixth seam 230A that defines a sixth interior bladder chamber 230C (e.g., filled with fluid, such as a gas). A fifth fluid channel 260E extends between and connects the fifth interior bladder chamber 228C with the sixth interior bladder chamber 230C and thus places the fifth interior bladder chamber 228C in fluid communication with the sixth interior bladder chamber 230C. In this illustrated example, a fifth joining seam portion 262E extends between and connects the fifth seam 228A and the sixth seam 230A (e.g., the fifth joining seam portion 262E may be located above and/or below the fifth fluid channel 260E).

Also, a fifth connector 210E and the fifth joining seam portion 262E engage the fifth seam 228A and the sixth seam 230A. In at least some examples of this technology, this fifth connector 210E may include or be formed from an elastic material (and thereby form an elastic connector engaging the fifth seam 228A and the sixth seam 230A). Fifth connector 210E, however, need not be an elastic connector (e.g., if one or more of the other connectors in the bladder system 100 is/are an elastic connector). The fifth connector 210E may be mounted across an opening 250E that extends between and separates the fifth bladder pod 228 from the sixth bladder pod 230. In this illustrated example, the fifth connector 210E (and the fifth opening 250E) extend upward to the top edge 100TE of the bladder system 100. Such an opening 250E, when present, may allow more relative movement between the fifth bladder pod 228 and the sixth bladder pod 230 (e.g., as the wearer moves within the article of footwear 1000).

FIG. 2E further shows that a sixth connector 210F and the sixth bladder pod 230 of this example include parts of the releasable fastener system 212, e.g., to enable the sixth bladder pod 230 to be engaged with the first bladder pod 220. The releasable fastener system 212 of FIG. 2E may have any of the features or options for the fastener system 212 described above in conjunction with FIG. 2C. Alternatively, if desired, a releasable fastener system may be omitted and the bladder system 100 of FIG. 2E may be fixed in a circular arrangement as shown in FIGS. 2A and 2B (e.g., with the first bladder pod 220 connected to the sixth bladder pod 230).

While FIG. 2E shows all of the bladder pods 220-230 in fluid communication with one another (via fluid channels 260A-260E), this is not a requirement. Rather, if desired, in at least some examples of this technology, one or more of bladder pods 220-230 may be in fluid isolation from one or more of the other bladder pods 220-230. Additionally or alternatively, subsets of bladder pods 220-230 may be in fluid communication with one another but in fluid isolation from one or more other subsets of bladder pods 220-230.

Additionally or alternatively, in some examples of this aspect of the technology as shown in FIG. 2E, the structure shown in FIG. 2E could be inverted vertically such that the fluid channels 260A-260E and/or joining seam portions 262A-262E are provided at the top of the bladder system 100. As yet another option, if desired, the bladder system of FIG. 2E could be structured such that one or more of the fluid channels 260A-260E and/or joining seam portions 262A-262E are located at a top area of the bladder system 100 and one or more of the fluid channels 260A-260E and/or joining seam portions 262A-262E are located at a bottom area of the bladder system 100. Still additionally or alternatively, if desired, one or more of the fluid channels 260A-260E and/or joining seam portions 262A-262E may be located in central area of the bladder system 100's height dimension.

The example bladder systems 100 described above in conjunction with FIGS. 2A-2F included six bladder pods 220-230 dispersed around the ankle and/or heel supporting area of the footwear upper base component 102 and/or article of footwear 1000. Other options are possible, e.g., options including more or fewer bladder pods. As some more specific examples, such bladder systems may have from 2 to 12 bladder pods, from 3 to 10 bladder pods, or even from 3 to 8 bladder pods. As one more specific example, FIG. 2G provides a view similar to FIG. 2F, but in the bladder system 100 of FIG. 2G, four bladder pods 220, 222, 224, and 230 are provided. These bladder pods 220, 222, 224, 230 may have any of the structures and/or arrangements described above for the pod structures of FIGS. 2A-2F, but with four pods instead of six (e.g., with the fourth bladder pod 230 permanently or releasably engaging the first bladder pod 220 via connector 210F and, in some examples, releasably engaged using a releasable fastener system 212). Thus, the four bladder pods 220, 222, 224, and 230 in the structure of FIG. 2G may be independent and separate components that are engaged with one another, e.g., solely by connectors 210A, 210B, 210C, and 210F (optionally with releasable fasteners 212) as described above in conjunction with FIG. 2C. Alternatively, the four bladder pods 220, 222, 224, and 230 in the structure of FIG. 2G may be fluid isolated bladder pods that are engaged with one another as a single part, e.g., by joining seam portions 104T and/or 104B as described above in conjunction with FIG. 2D. Still alternatively, the four bladder pods 220, 222, 224, and 230 in the structure of FIG. 2G may be bladder pods that are engaged with one another as a single part and in fluid communication with one another, e.g., as described above in conjunction with FIG. 2E. As yet another alternative, a mixture of independent and co-joined bladder pods may be provided in the structure of FIG. 2G (e.g., mixing features of the structures shown in FIGS. 2C-2E).

While other arrangements are possible, in some examples of this technology, bladder pods (e.g., 220-230) and the one or more elastic connectors (e.g., one or more of connectors 210A-210F described above in conjunction with FIGS. 2A-2G) may be sized, shaped, and/or located on the upper base component 102 such that the bladder system 100 extends around the wearer's foot or leg at the ankle area. The elastic connector(s) (e.g., one or more of 210A-210F) may enable the bladder system 100 to fit snugly around the wearer's ankle and/or heel area. The elastic connector(s) (e.g., one or more of 210A-210F) also may allow some relative movement between the bladder pods (e.g., two or more of bladder pods 220, 222, 224, 226, 228, and/or 230), e.g., as a wearer moves in the article of footwear 1000. In this manner, the bladder system 100 provides support and a snug fit and returns to its original size, shape, and/or location once the force from the wearer's movement is removed or sufficiently relaxed.

Figure 3A:
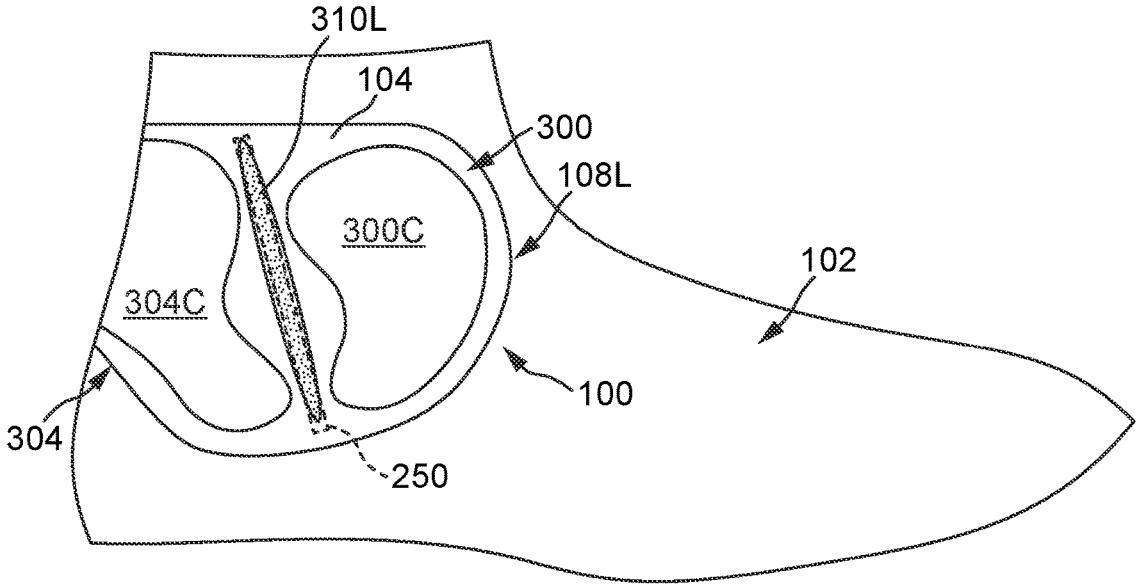
FIGS. 3A-3B provide lateral and medial views, respectively, of another bladder system and upper in accordance with some examples and aspects of this technology.
Figure 3B:
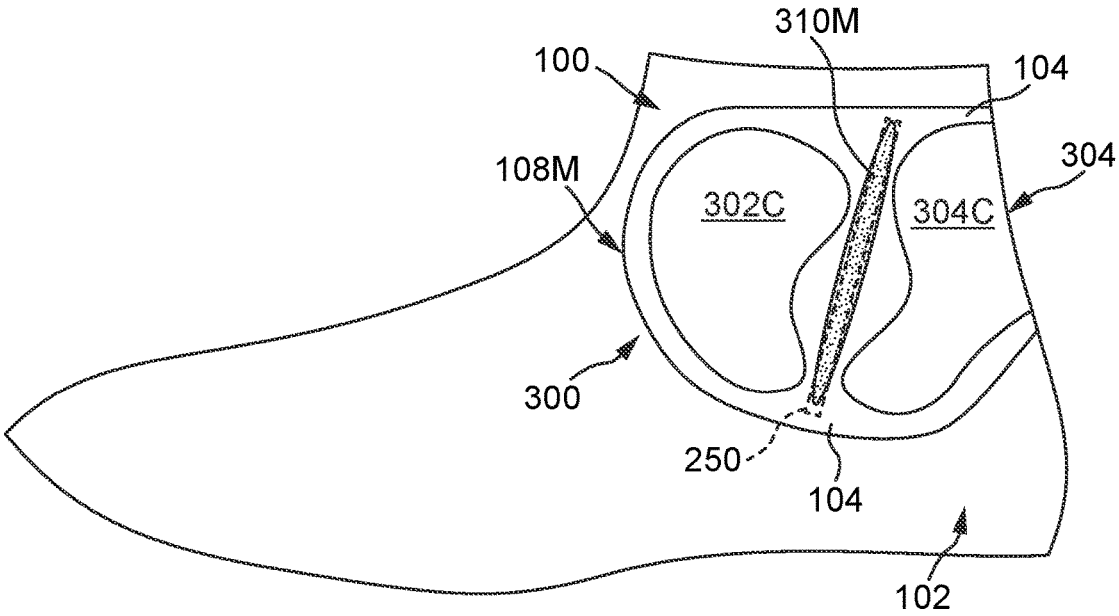

FIGS. 3A and 3B show lateral and medial side views, respectively, of a footwear upper base component 102 having another example bladder system 100 engaged with it. Where the same reference numbers are used in FIGS. 3A-3B as used in FIGS. 1A-2G, the same or similar parts are being referenced (e.g., with any of the options or alternatives described above), and much of the overlapping disclosure may be omitted. This upper base component 102 may be engaged with a sole structure 1004, e.g., in the same manners and/or of the same types described above.

The example bladder system 100 of FIGS. 3A-3B includes three bladder pods: (i) a lateral side bladder pod 300, (ii) a medial side bladder pod 302, and (iii) a rear central bladder pod 304 located between the lateral side bladder pod 300 and the medial side bladder pod 302. The central bladder pod 304 of this example extends around a rear heel and/or ankle containing area of the upper base component 102 from the lateral side to the medial side of the upper base component 102. This example rear central bladder pod 304 is open to permit free fluid movement within the interior chamber 304C between the medial and lateral sides.

In this illustrated example, interior chamber 300C of the lateral side bladder pod 300, the interior chamber 302C of the medial side bladder pod 302, and the interior chamber 304C of the rear central bladder pod 304 are in fluid isolation from one another. Specifically, these interior chambers 300C, 302C, 304C are separated from one another by sealed seams 104 (e.g., where interior surfaces 100AI and 100BI of two thermoplastic elastomer sheets 100A, 100B are engaged together as described above in conjunction with FIG. 1D). Similar to the example of FIGS. 1A-1C, the bladder system 100 of FIGS. 3A and 3B does not completely encircle the wearer's foot and/or leg (e.g., the bladder system 100 has a forward lateral end or edge 108L and a forward medial end or edge 108M).

This example bladder system 100 includes a lateral side elastic connector 310L and a medial side elastic connector 310M. In some examples of this technology, the lateral side bladder pod 300 may be an independent and separate component from the rear central bladder pod 304, and the lateral side elastic connector 310L may connect the lateral side bladder pod 300 and the rear central bladder pod 304, e.g., in the manners described above in conjunction with FIG. 2C. Alternatively, the lateral side bladder pod 300 may be joined to the rear central bladder pod 304, e.g., via a joining seam portion, and these pods 300, 304 may be in fluid isolation from one another. In such structures, the lateral side elastic connector 310L may extend between and at least partially separate these pods 300, 304 in the manners described above in conjunction with FIG. 2D. The lateral side elastic connector 310L may be mounted across a groove, slot, or opening 250 (e.g., akin to openings 250A-250E), e.g., as described above in conjunction with FIG. 2D. Such a groove, slot, or opening 250 may allow better relative movement between the lateral side bladder pod 300 and the rear central bladder pod 304.

Additionally or alternatively, in some examples of this technology, the medial side bladder pod 302 may be an independent and separate component from the rear central bladder pod 304, and the medial side elastic connector 310M may connect the medial side bladder pod 302 and the rear central bladder pod 304, e.g., in the manners described above in conjunction with FIG. 2C. Alternatively, the medial side bladder pod 302 may be joined to the rear central bladder pod 304, e.g., via a joining seam portion, and these pods 302, 304 may be in fluid isolation from one another. In such structures, the medial side elastic connector 310M may extend between and at least partially separate these pods 302, 304 in the manners described above in conjunction with FIG. 2D. The medial side elastic connector 310M may be mounted across a groove, slot, or opening 250 (e.g., akin to openings 250A-250E), e.g., as described above in conjunction with FIG. 2D. Such a groove, slot, or opening 250 may allow better relative movement between the medial side bladder pod 302 and the rear central bladder pod 304.

Still additionally or alternatively, at least two of the lateral side bladder pod 300, the medial side bladder pod 302, and/or the rear central bladder pod 304 may be in fluid communication with one another. This may be accomplished, for example, via one or more fluid passages (akin to fluid passage 132 described above in conjunction with FIGS. 1A-1C) and/or by one or more fluid channels (akin to fluid channels 260A-260E described above in conjunction with FIG. 2E).

While other arrangements are possible, in some examples of this technology, bladder pods 300, 302, 304 and the one or more elastic connectors 310L, 310M may be sized, shaped, and/or located on the upper base component 102 such that the bladder system 100 extends around the sides and rear of the wearer's foot and/or leg at the ankle and/or heel area. The elastic connector(s) (e.g., one or more of 310L and/or 310M) may enable the bladder system 100 to fit snugly around the wearer's ankle and/or heel area. The elastic connector(s) 310L and/or 310M also may allow some relative movement between the bladder pods 300, 302, 304, e.g., as a wearer moves in an article of footwear including the upper of FIGS. 3A-3B. In this manner, the bladder system 100 provides support and a snug fit and returns to its original size, shape, and/or location once the force from the wearer's movement is removed or sufficiently relaxed.

Figure 4:
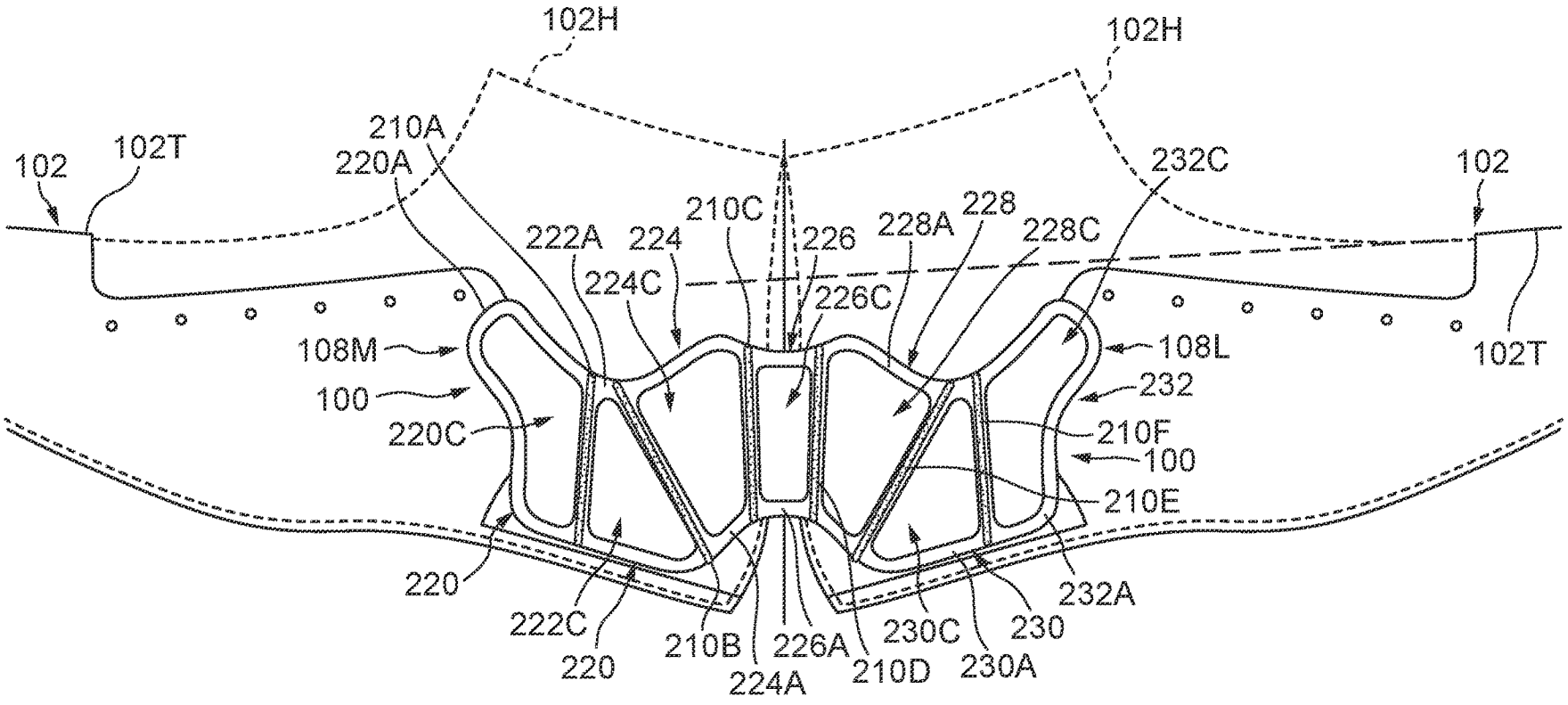
FIG. 4 provides a view of another example bladder system and upper in accordance with some examples and aspects of this technology.

FIG. 4 illustrates a footwear upper base component 102 having another example bladder system 100 engaged with it. Where the same reference numbers are used in FIG. 4 as used in FIGS. 1A-3B, the same or similar parts are being referenced (e.g., with any of the options or alternatives described above), and much of the overlapping disclosure may be omitted. This upper base component 102 may be engaged with a sole structure 1004, e.g., in the same manners and/or of the same types described above.

FIG. 4 shows the rear portion of upper base component 102 (formed from one or more parts) as an upper blank in a flat configuration (e.g., before it is completely fixed together to form the shaped upper) with a flattened bladder system 100 applied to it. The illustrated structure of FIG. 4 includes: (a) solid lines at the top of the upper base component 102 to illustrate a top line 102T of a low-top upper structure and (b) broken lines at the top of the upper base component 102 to illustrate a top line 102H of a high-top upper structure. In this illustrated example, the bladder system 100 is located somewhat lower in the heel region of the upper base component 102, e.g., to support the heel and/or lower ankle areas. But a similarly structured bladder system 100 could be located further upward and/or extend further upward in the heel and/or ankle areas, e.g., as shown in FIGS. 1A-3B.

In the example of FIG. 4, similar to the examples of FIGS. 1A-1C, 3A, and 3B, the bladder system 100 extends around the rear area of the wearer's foot and/or leg but does not completely encircle the wearer's foot and/or leg (e.g., it does not extend across the front or instep area of the upper base component 102). Rather, the bladder system 100 of FIG. 4 has a forward lateral end or edge 108L and a forward medial end or edge 108M.

The bladder system 100 of FIG. 4 includes seven bladder pods 220, 222, 224, 226, 228, 230, 232. Seams (e.g., formed like seam 104 between interior surfaces 100AI, 100BI of two thermoplastic elastomer sheets 100A, 100B as shown in FIG. 1D) 220A, 222A, 224A, 226A, 228A, 230A, 232A, respectively, define interior bladder chambers 220C, 222C, 224C, 226C, 228C, 230C, 232C of the bladder pods 220, 222, 224, 226, 228, 230, 232, respectively. In this illustrated example: (a) bladder pod 220 provides forward medial heel and/or ankle support, (b) bladder pod 222 provides mid medial heel and/or ankle support, (c) bladder pod 224 provides rear medial heel and/or ankle support, (d) bladder pod 226 bridges a central rear heel and/or ankle area from the medial side to the lateral side of the footwear base upper component 102, (e) bladder pod 228 provides rear lateral heel and/or ankle support, (f) bladder pod 230 provides mid lateral heel and/or ankle support, and (g) bladder pod 232 provides forward lateral heel and/or ankle support. But in some examples of this technology, more or fewer bladder pods could be included in the structure of FIG. 4.

The seams 220A, 222A, 224A, 226A, 228A, 230A, 232A between adjacent bladder interior chambers 220C, 222C, 224C, 226C, 228C, 230C, 232C are engaged by connectors 210A-210F. More specifically, in this illustrated example: (a) connector 210A extends between and joins bladder pods 220 and 222 (e.g., engaging seams 220A and 222A); (b) connector 210B extends between and joins bladder pods 222 and 224 (e.g., engaging seams 222A and 224A); (c) connector 210C extends between and joins bladder pods 224 and 226 (e.g., engaging seams 224A and 226A); (d) connector 210D extends between and joins bladder pods 226 and 228 (e.g., engaging seams 226A and 228A); (e) connector 210E extends between and joins bladder pods 228 and 230 (e.g., engaging seams 228A and 230A); and (f) connector 210F extends between and joins bladder pods 230 and 232 (e.g., engaging seams 230A and 232A). One or more of connectors 210A-210F may comprise an elastic connector (e.g., made from and/or structured to include an elastic material).

The bladder system 100 structure of FIG. 4 includes the bladder pods 220, 222, 224, 226, 228, 230, 232 formed as independent and separate components that are engaged together via connectors 210A-210F (and in some examples, engaged together solely by connectors 210A-210F), e.g., in the manner described above in conjunction with FIG. 2C. Thus, the interior chambers 220C, 222C, 224C, 226C, 228C, 230C, 232C of bladder pods 220, 222, 224, 226, 228, 230, 232, respectively, are not in fluid communication with one another.

Alternatively, if desired, the bladder system 100 of FIG. 4 may be constructed in the manner described above in conjunction with FIG. 2D, e.g., where the bladder pods 220, 222, 224, 226, 228, 230, 232 are formed as a single component part, but the bladder pod interior chambers 220C, 222C, 224C, 226C, 228C, 230C, 232C remain in fluid isolation from (i.e., not in fluid communication with) one another. In such structures, a top joining seam 104T and/or a bottom joining seam 104T (or other joining seam portion (s)) of the types shown in FIG. 2D may be provided to extend between and/or join seams 220A, 222A, 224A, 226A, 228A, 230A, 232A of adjacent bladder pods 220, 222, 224, 226, 228, 230, 232. Additionally, if desired, the connector(s) 210A-210F may be mounted across openings, e.g., of the types shown in FIG. 2D as elements 250A-250E.

As another alternative, if desired, the bladder system 100 of FIG. 4 may be constructed in the manner described above in conjunction with FIG. 2E, e.g., where the bladder pods 220, 222, 224, 226, 228, 230, 232 are formed as a single component part and two or more of the bladder pod interior chambers 220C, 222C, 224C, 226C, 228C, 230C, 232C are in fluid communication with one another. In such structures, two or more fluid passages (e.g., akin to elements 260A-260E in FIG. 2E) may be provided to place the desired interior chambers 220C, 222C, 224C, 226C, 228C, 230C, 232C in fluid communication with one another. Additionally or alternatively, if desired, one or more joining seam portions (e.g., akin to elements 262A-262E in FIG. 2E) may be provided to form the desired bladder pods 220, 222, 224, 226, 228, 230, 232 as a single or co-joined structure. Still additionally or alternatively, if desired, the connector(s) 210A-210F may be mounted across openings, e.g., of the types shown and describe above in conjunction with FIG. 2E and elements 250A-250E.

The elastic connector(s) (e.g., one or more of 210A-210F in FIG. 4) may enable the bladder system 100 to fit snugly around the wearer's ankle and/or heel area. The elastic connector(s) (e.g., one or more of 210A-210F in FIG. 4) also may allow some relative movement between the bladder pods 220, 222, 224, 226, 228, 230, 232, e.g., as a wearer moves in an article of footwear including the upper of FIG. 4. In this manner, bladder system 100 provides support and a snug fit and returns to its original size, shape, and/or location once the force from the wearer's movement is removed or sufficiently relaxed.

Figure 5A:
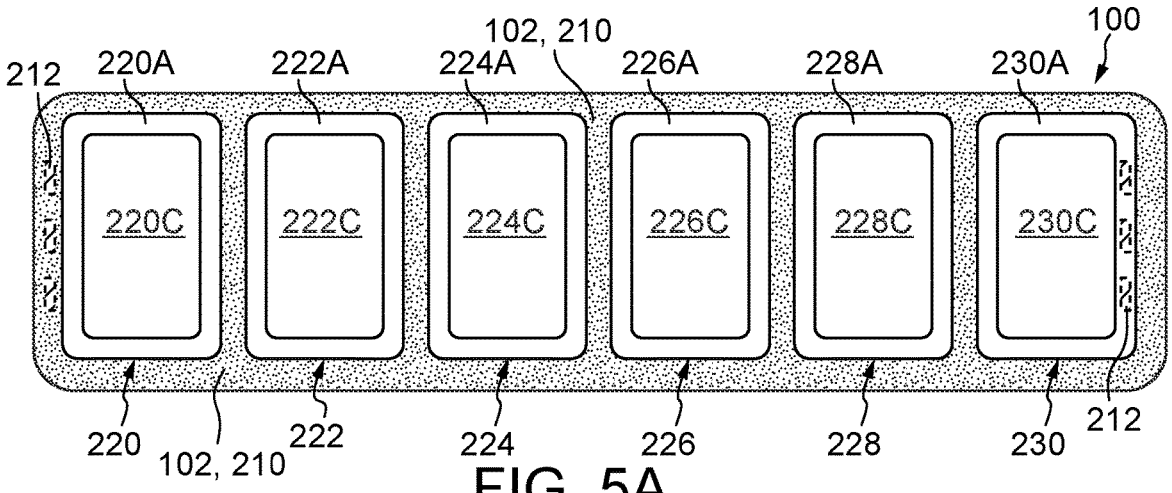
FIGS. 5A-5C provide various views of other arrangements of bladder system and uppers in accordance with some examples and aspects of this technology.
Figure 5B:
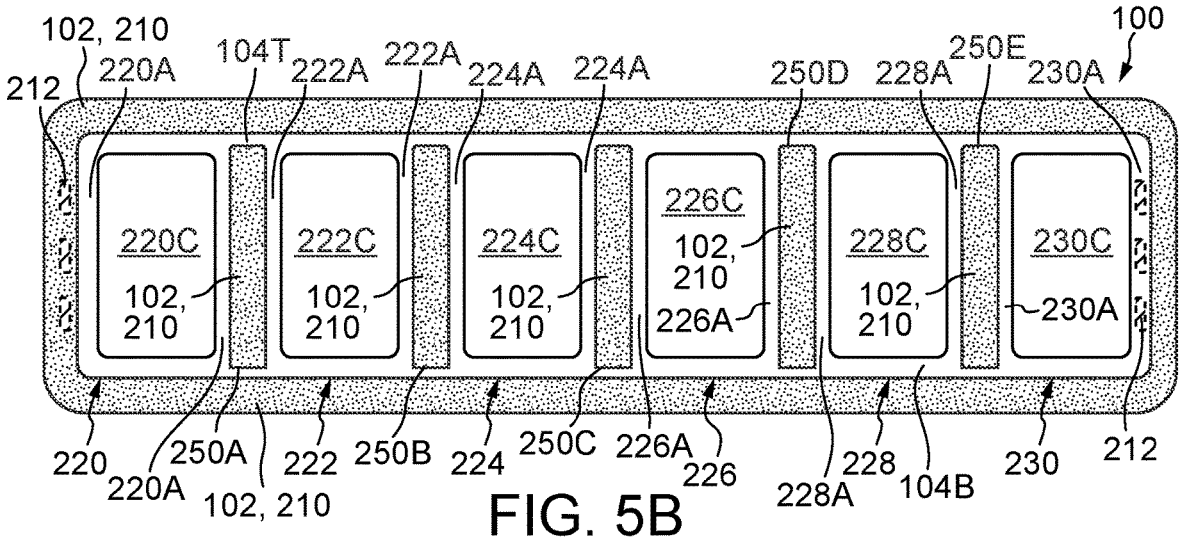
Figure 5C:
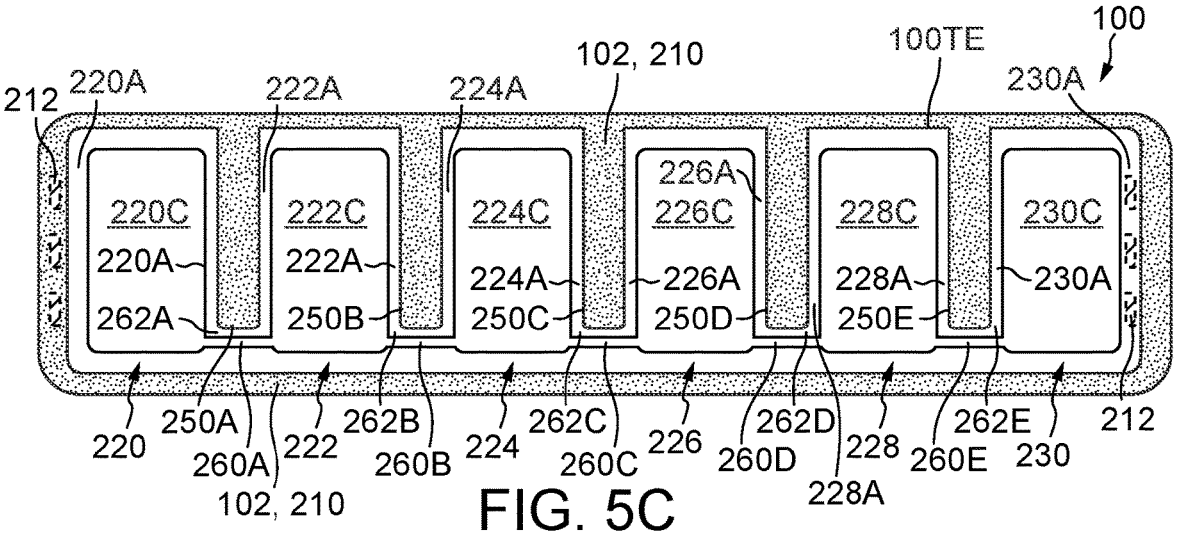

FIGS. 5A-5C provide views similar to FIGS. 2C-2E, respectively, but FIGS. 5A-5C illustrate alternative bladder system structures in accordance with some aspects and examples of this technology. Where the same reference numbers are used in FIGS. 5A-5C as used in the other figures (including FIGS. 2C-2E), the same or similar parts are being referenced (e.g., with any of the options or alternatives described above), and much of the overlapping disclosure may be omitted. In the examples of FIGS. 2C-2E, the bladder pods 220, 222, 224, 226, 228, and 230 are joined by separate and individual elastic connectors 210A, 210B, 210C, 210D, 210E, and 210F. In the examples of FIGS. 5A-5C, on the other hand, two or more of the bladder pods 220, 222, 224, 226, 228, and 230 are joined by a single elastic component 210. Additionally or alternatively, if desired, this single elastic connector 210 may form a base upper component 102, e.g., an upper component to which one or more of the bladder pods 220, 222, 224, 226, 228, and 230 is connected, e.g., by an adhesive free or adhesive bond, by sewing, etc. FIGS. illustrate portions of elastic component 210 and/or upper base component 102 joining all of the illustrated bladder pods 220, 222, 224, 226, 228, and 230. As shown, portions of the elastic component 210 or elastic material portions of upper base component 102 span and/or are located in one or more of the gaps or openings (250A-250E) between adjacent bladder pods 220, 222, 224, 226, 228, and 230. In other structures, however, a single elastic component 210 and/or upper base component 102 may join any desired number of bladder pods (e.g., any two or more of 220, 222, 224, 226, 228, and 230). Additionally, the elastic component 210 and/or upper base component 102 shown in FIGS. 5A-5C may extend to provide any desired shape or structure, e.g., including shapes and/or structures suitable to provide and/or connect into a footwear upper and/or article of footwear structure.

In similar manners to the alternative structures shown in FIGS. 5A-5C, one or more of the elastic connectors 310L, 310M of FIGS. 3A and 3B may be replaced by an single elastic component that joins two or more of the bladder chambers 300C, 302C, 304C and/or forms a backing layer to which one or more of the bladder chambers 300C, 302C, 304C is attached. Such an elastic component also may form one of the footwear upper base components 102 of a footwear upper and/or article of footwear structure.

Also, in similar manners to the alternative structures shown in FIGS. 5A-5C, one or more of the elastic connectors 210A, 210B, 210C, 210D, 210E, 210F of FIG. 4 may be replaced by an single elastic component that joins two or more of the bladder pods 220, 220, 222, 224, 226, 228, 230, 232 and/or forms a backing layer to which one or more of the bladder pods 220, 220, 222, 224, 226, 228, 230, 232 is attached. Such an elastic component also may form one of the footwear upper base components 102 of a footwear upper and/or article of footwear structure.

In the examples described above, the various elastic connectors (e.g., one or more of 150, 210A-210F, 310L, 310M) may be fabric-type elastic connector. Such connectors may be engaged with the bladder systems 100 by stitching or sewing. As one example, the stitching or sewing may extend through the fabric-type elastic connector and the seams of the bladder pods to be joined by the fabric-type elastic connectors. As another example, ends of a fabric-type elastic connector may be looped through an opening (e.g., 250, 250A-250E) in the seams of the bladder pods and then the free end of the fabric-type elastic connector may be sewn to itself. Additionally or alternatively, in some examples of this technology, one or more (and optionally all) of the elastic connectors may comprise hardware-type elastic connectors (e.g., springs). Such hardware-type elastic connectors may be engaged with and extend between the seams of the bladder pods.

Bladder systems 100 in accordance with aspects of this technology may adjust and conform to the shape of a wearer's foot and/or leg, e.g., due to: (a) the ability of fluid to move within and/or between the bladder pod(s) and/or (b) the ability of the elastic component(s) to stretch and change its (their) size and/or shape. Thus, bladder systems 100 in accordance with aspects of this technology provide support and a snug fit around a wearer's foot; return to its/their original size, shape, and/or location once the force from the wearer's movement is removed or sufficiently relaxed; and/or provide impact force attenuation properties, e.g., to protect the wearer's ankle and/or heel.

III. CONCLUSION

The present invention is disclosed above and in the accompanying drawings with reference to a variety of example structures. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims.

For the avoidance of doubt, the present application includes at least the subject matter described in the following numbered Clauses:

Clause 1. A bladder system for an article of footwear, comprising:

a first bladder pod including a first seam that defines a first interior bladder chamber;

a second bladder pod including a second seam that defines a second interior bladder chamber; and a first elastic connector engaging the first seam and the second seam.

Clause 2. The bladder system according to clause 1, wherein: (i) the first seam completely surrounds and seals the first interior bladder chamber, (ii) the second seam completely surrounds and seals the second interior bladder chamber, and (iii) the first interior bladder chamber is not in fluid communication with the second interior bladder chamber.

Clause 3. The bladder system according to clause 1, further comprising: a third bladder pod including a third seam that defines a third interior bladder chamber; and a second elastic connector engaging the second seam and the third seam.

Clause 4. The bladder system according to clause 3, wherein: (i) the first seam completely surrounds and seals the first interior bladder chamber, (ii) the second seam completely surrounds and seals the second interior bladder chamber, (iii) the third seam completely surrounds and seals the third interior bladder chamber, and (iv) the first interior bladder chamber, the second interior bladder chamber, and the third interior bladder chamber are not in fluid communication with one another.

Clause 5. The bladder system according to clause 3, further comprising: a fourth bladder pod including a fourth seam that defines a fourth interior bladder chamber; and a third elastic connector engaging the third seam and the fourth seam.

Clause 6. The bladder system according to clause 5, further comprising: a fourth elastic connector engaging the fourth seam and the first seam.

Clause 7. The bladder system according to clause 5, wherein: (i) the first seam completely surrounds and seals the first interior bladder chamber, (ii) the second seam completely surrounds and seals the second interior bladder chamber, (iii) the third seam completely surrounds and seals the third interior bladder chamber, (iv) the fourth seam completely surrounds and seals the fourth interior bladder chamber, and (v) the first interior bladder chamber, the second interior bladder chamber, the third interior bladder chamber, and the fourth interior bladder chamber are not in fluid communication with one another.

Clause 8. The bladder system according to clause 5, further comprising: a fifth bladder pod including a fifth seam that defines a fifth interior bladder chamber; and a fourth elastic connector engaging the fourth seam and the fifth seam.

Clause 9. The bladder system according to clause 8, wherein: (i) the first seam completely surrounds and seals the first interior bladder chamber, (ii) the second seam completely surrounds and seals the second interior bladder chamber, (iii) the third seam completely surrounds and seals the third interior bladder chamber, (iv) the fourth seam completely surrounds and seals the fourth interior bladder chamber, (v) the fifth seam completely surrounds and seals the fifth interior bladder chamber, and (vi) the first interior bladder chamber, the second interior bladder chamber, the third interior bladder chamber, the fourth interior bladder chamber, and the fifth interior bladder chamber are not in fluid communication with one another.

Clause 10. The bladder system according to clause 8, further comprising: a sixth bladder pod including a sixth seam that defines a sixth interior bladder chamber; and a fifth elastic connector engaging the fifth seam and the sixth seam.

Clause 11. The bladder system according to clause 10, further comprising: a seventh bladder pod including a seventh seam that defines a seventh interior bladder chamber; and a sixth elastic connector engaging the sixth seam and the seventh seam.

Clause 12. The bladder system according to clause 10, further comprising a sixth elastic connector engaging the sixth seam and the first seam.

Clause 13. The bladder system according to any one of clauses 10 to 12, wherein: (i) the first seam completely surrounds and seals the first interior bladder chamber, (ii) the second seam completely surrounds and seals the second interior bladder chamber, (iii) the third seam completely surrounds and seals the third interior bladder chamber, (iv)

the fourth seam completely surrounds and seals the fourth interior bladder chamber, (v) the fifth seam completely surrounds and seals the fifth interior bladder chamber, (vi) the sixth seam completely surrounds and seals the sixth interior bladder chamber, and (vii) the first interior bladder chamber, the second interior bladder chamber, the third interior bladder chamber, the fourth interior bladder chamber, the fifth interior bladder chamber, and the sixth interior bladder chamber are not in fluid communication with one another.

Clause 14. The bladder system according to clause 1, wherein the first interior bladder chamber is in fluid communication with the second interior bladder chamber.

Clause 15. The bladder system according to clause 14, wherein a first fluid channel extends between and connects the first interior bladder chamber with the second interior bladder chamber.

Clause 16. The bladder system according to clause 1, further comprising: a third bladder pod including a third seam that defines a third interior bladder chamber, wherein the first elastic connector connects to the third seam.

Clause 17. The bladder system according to clause 16, wherein the first interior bladder chamber, the second interior bladder chamber, and the third interior bladder chamber are not in fluid communication with one another.

Clause 18. The bladder system according to clause 16, wherein the first interior bladder chamber, the second interior bladder chamber, and the third interior bladder chamber are in fluid communication with one another.

Clause 19. The bladder system according to any one of clauses 16 to 18, wherein the third bladder pod includes a first pod chamber, a second pod chamber, and a fluid passage connecting the first pod chamber and the second pod chamber to place the first pod chamber in fluid communication with the second pod chamber.

Clause 20. The bladder system according to clause 1, wherein a first joining seam portion extends between and connects the first seam and the second seam.

Clause 21. The bladder system according to clause 20, wherein the first interior bladder chamber and the second interior bladder chamber are not in fluid communication with one another.

Clause 22. The bladder system according to clause 20, wherein the first interior bladder chamber and the second interior bladder chamber are in fluid communication with one another.

Clause 23. The bladder system according to clause 1, further comprising: a third bladder pod including a third seam that defines a third interior bladder chamber; and a second elastic connector engaging the second seam and the third seam, wherein: (i) a first joining seam portion extends between and connects the first seam and the second seam, and (ii) a second joining seam portion extends between and connects the second seam and the third seam.

Clause 24. The bladder system according to clause 23, wherein the first interior bladder chamber, the second interior bladder chamber, and the third interior bladder chamber are not in fluid communication with one another.

Clause 25. The bladder system according to clause 23, wherein the first interior bladder chamber, the second interior bladder chamber, and the third interior bladder chamber are in fluid communication with one another.

Clause 26. The bladder system according to clause 25, wherein: (i) a first fluid channel extends between and connects the first interior bladder chamber with the second interior bladder chamber, and (ii) a second fluid channel extends between and connects the second interior bladder chamber with the third interior bladder chamber.

Clause 27. The bladder system according to clause 23, further comprising: a fourth bladder pod including a fourth seam that defines a fourth interior bladder chamber; and a third elastic connector engaging the third seam and the fourth seam.

Clause 28. The bladder system according to clause 27, further comprising: a fourth elastic connector engaging the fourth seam and the first seam.

Clause 29. The bladder system according to clause 27, wherein: (i) a third joining seam portion extends between and connects the third seam and the fourth seam.

Clause 30. The bladder system according to any one of clauses 27 to 29, wherein the first interior bladder chamber, the second interior bladder chamber, the third interior bladder chamber, and the fourth interior bladder chamber are not in fluid communication with one another.

Clause 31. The bladder system according to any one of clauses 27 to 29, wherein the first interior bladder chamber, the second interior bladder chamber, the third interior bladder chamber, and the fourth interior bladder chamber are in fluid communication with one another.

Clause 32. The bladder system according to clause 31, wherein: (i) a first fluid channel extends between and connects the first interior bladder chamber with the second interior bladder chamber, (ii) a second fluid channel extends between and connects the second interior bladder chamber with the third interior bladder chamber, and (iii) a third fluid channel extends between and connects the third interior bladder chamber with the fourth interior bladder chamber.

Clause 33. The bladder system according to clause 27, further comprising: a fifth bladder pod including a fifth seam that defines a fifth interior bladder chamber; and a fourth elastic connector engaging the fourth seam and the fifth seam.

Clause 34. The bladder system according to clause 33, wherein: (i) a third joining seam portion extends between and connects the third seam and the fourth seam, and (ii) a fourth joining seam portion extends between and connects the fourth seam and the fifth seam.

Clause 35. The bladder system according to clause 33 or 34, wherein the first interior bladder chamber, the second interior bladder chamber, the third interior bladder chamber, the fourth interior bladder chamber, and the fifth interior bladder chamber are not in fluid communication with one another.

Clause 36. The bladder system according to clause 33 or 34, wherein the first interior bladder chamber, the second interior bladder chamber, the third interior bladder chamber, the fourth interior bladder chamber, and the fifth interior bladder chamber are in fluid communication with one another.

Clause 37. The bladder system according to clause 36, wherein: (i) a first fluid channel extends between and connects the first interior bladder chamber with the second interior bladder chamber, (ii) a second fluid channel extends between and connects the second interior bladder chamber with the third interior bladder chamber, (iii) a third fluid channel extends between and connects the third interior bladder chamber with the fourth interior bladder chamber, and (iv) a fourth fluid channel extends between and connects the fourth interior bladder chamber with the fifth interior bladder chamber.

Clause 38. The bladder system according to clause 33, further comprising: a sixth bladder pod including a sixth seam that defines a sixth interior bladder chamber; and a fifth elastic connector engaging the fifth seam and the sixth seam.

Clause 39. The bladder system according to clause 38, further comprising: a seventh bladder pod including a seventh seam that defines a seventh interior bladder chamber; and a sixth elastic connector engaging the sixth seam and the seventh seam.

Clause 40. The bladder system according to clause 38, further comprising a sixth elastic connector engaging the sixth seam and the first seam.

Clause 41. The bladder system according to any one of clauses 38 to 40, wherein: (i) a third joining seam portion extends between and connects the third seam and the fourth seam, (ii) a fourth joining seam portion extends between and connects the fourth seam and the fifth seam, and (iii) a fifth joining seam portion extends between and connects the fifth seam and the sixth seam.

Clause 42. The bladder system according to any one of clauses 38 to 41, wherein the first interior bladder chamber, the second interior bladder chamber, the third interior bladder chamber, the fourth interior bladder chamber, the fifth interior bladder chamber, and the sixth interior bladder chamber are not in fluid communication with one another.

Clause 43. The bladder system according to any one of clauses 38 to 41, wherein the first interior bladder chamber, the second interior bladder chamber, the third interior bladder chamber, the fourth interior bladder chamber, the fifth interior bladder chamber, and the sixth interior bladder chamber are in fluid communication with one another.

Clause 44. The bladder system according to clause 43, wherein: (i) a first fluid channel extends between and connects the first interior bladder chamber with the second interior bladder chamber, (ii) a second fluid channel extends between and connects the second interior bladder chamber with the third interior bladder chamber, (iii) a third fluid channel extends between and connects the third interior bladder chamber with the fourth interior bladder chamber, (iv) a fourth fluid channel extends between and connects the fourth interior bladder chamber with the fifth interior bladder chamber, and (v) a fifth fluid channel extends between and connects the fifth interior bladder chamber with the sixth interior bladder chamber.

Clause 45. The bladder system according to clause 1, wherein the first bladder pod constitutes a separate component from the second bladder pod.

Clause 46. The bladder system according to clause 45, wherein the first elastic connector is the only structural element extending between the first bladder pod and the second bladder pod.

Clause 47. The bladder system according to clause 1, further comprising: a third bladder pod including a third seam that defines a third interior bladder chamber; and a second elastic connector engaging the second seam and the third seam, wherein the first bladder pod, the second bladder pod, and the third bladder pod constitute separate components.

Clause 48. The bladder system according to clause 47, wherein: (i) the first elastic connector is the only structural element extending between the first bladder pod and the second bladder pod, and (ii) the second elastic connector is the only structural element extending between the second bladder pod and the third bladder pod.

Clause 49. The bladder system according to clause 47, further comprising: a fourth bladder pod including a fourth seam that defines a fourth interior bladder chamber; and a third elastic connector engaging the third seam and the fourth seam, wherein the first bladder pod, the second bladder pod, the third bladder pod, and the fourth bladder pod constitute separate components.

Clause 50. The bladder system according to clause 49, further comprising: a fourth elastic connector engaging the fourth seam and the first seam.

Clause 51. The bladder system according to clause 49, wherein: (i) the first elastic connector is the only structural element extending between the first bladder pod and the second bladder pod, (ii) the second elastic connector is the only structural element extending between the second bladder pod and the third bladder pod, and (iii) the third elastic connector is the only structural element extending between the third bladder pod and the fourth bladder pod.

Clause 52. The bladder system according to clause 49, further comprising: a fifth bladder pod including a fifth seam that defines a fifth interior bladder chamber; and a fourth elastic connector engaging the fourth seam and the fifth seam, wherein the first bladder pod, the second bladder pod, the third bladder pod, the fourth bladder pod, and the fifth bladder pod constitute separate components.

Clause 53. The bladder system according to clause 52, wherein: (i) the first elastic connector is the only structural element extending between the first bladder pod and the second bladder pod, (ii) the second elastic connector is the only structural element extending between the second bladder pod and the third bladder pod, (iii) the third elastic connector is the only structural element extending between the third bladder pod and the fourth bladder pod, and (iv) the fourth elastic connector is the only structural element extending between the fourth bladder pod and the fifth bladder pod.

Clause 54. The bladder system according to clause 52, further comprising: a sixth bladder pod including a sixth seam that defines a sixth interior bladder chamber; and a fifth elastic connector engaging the fifth seam and the sixth seam, wherein the first bladder pod, the second bladder pod, the third bladder pod, the fourth bladder pod, the fifth bladder pod, and the sixth bladder pod constitute separate components.

Clause 55. The bladder system according to clause 54, further comprising: a seventh bladder pod including a seventh seam that defines a seventh interior bladder chamber; and a sixth elastic connector engaging the sixth seam and the seventh seam, wherein the first bladder pod, the second bladder pod, the third bladder pod, the fourth bladder pod, the fifth bladder pod, the sixth bladder pod, and the seventh bladder pod constitute separate components.

Clause 56. The bladder system according to clause 54, wherein: (i) the first elastic connector is the only structural element extending between the first bladder pod and the second bladder pod, (ii) the second elastic connector is the only structural element extending between the second bladder pod and the third bladder pod, (iii) the third elastic connector is the only structural element extending between the third bladder pod and the fourth bladder pod, (iv) the fourth elastic connector is the only structural element extending between the fourth bladder pod and the fifth bladder pod, and (v) the fifth elastic connector is the only structural element extending between the fifth bladder pod and the sixth bladder pod.

Clause 57. The bladder system according to clause 54 or 56, further comprising: a sixth elastic connector engaging the sixth seam and the first seam.

Clause 58. The bladder system according to clause 57, wherein: (i) the first elastic connector is the only structural element extending between the first bladder pod and the second bladder pod, (ii) the second elastic connector is the only structural element extending between the second bladder pod and the third bladder pod, (iii) the third elastic connector is the only structural element extending between the third bladder pod and the fourth bladder pod, (iv) the fourth elastic connector is the only structural element extending between the fourth bladder pod and the fifth bladder pod, (v) the fifth elastic connector is the only structural element extending between the fifth bladder pod and the sixth bladder pod, and (vi) the sixth elastic connector is the only structural element extending between the sixth bladder pod and the first bladder pod.

Clause 59. An upper for an article of footwear, comprising:
- an upper base component including one or more upper component parts; and
- a bladder system according to any one of clauses 1 to 58 engaged with the upper base component.

Clause 60. An article of footwear, comprising:
- an upper base component including one or more upper component parts;
- a bladder system according to any one of clauses 1 to 58 engaged with the upper base component; and
- a sole structure engaged with the upper base component.

Clause 61. An upper for an article of footwear, comprising:
- an upper base component including one or more upper component parts; and
- a bladder system engaged with the upper base component, wherein the bladder system is located at an ankle covering portion and/or a heel covering portion of the upper base component and includes:
  - a first bladder pod including a first seam that defines a first interior bladder chamber,
  - a second bladder pod including a second seam that defines a second interior bladder chamber, and
  - a first elastic connector engaging the first seam and the second seam.

Clause 62. The upper according to clause 61, wherein: (i) the first seam completely surrounds and seals the first interior bladder chamber, (ii) the second seam completely surrounds and seals the second interior bladder chamber, and (iii) the first interior bladder chamber is not in fluid communication with the second interior bladder chamber.

Clause 63. The upper according to clause 61, further comprising: a third bladder pod including a third seam that defines a third interior bladder chamber; and a second elastic connector engaging the second seam and the third seam.

Clause 64. The upper according to clause 63, wherein: (i) the first seam completely surrounds and seals the first interior bladder chamber, (ii) the second seam completely surrounds and seals the second interior bladder chamber, (iii) the third seam completely surrounds and seals the third interior bladder chamber, and (iv) the first interior bladder chamber, the second interior bladder chamber, and the third interior bladder chamber are not in fluid communication with one another.

Clause 65. The upper according to clause 64, further comprising: a fourth bladder pod including a fourth seam that defines a fourth interior bladder chamber; and a third elastic connector engaging the third seam and the fourth seam.

Clause 66. The upper according to clause 65, further comprising: a fourth elastic connector engaging the fourth seam and the first seam.

Clause 67. The upper according to clause 66, wherein the first bladder pod, the first elastic connector, the second bladder pod, the second elastic connector, the third bladder pod, the third elastic connector, the fourth bladder pod, and the fourth elastic connector are arranged in a closed loop and configured to extend completely around the ankle covering portion of the upper.

Clause 68. The upper according to clause 65, wherein: (i) the first seam completely surrounds and seals the first interior bladder chamber, (ii) the second seam completely surrounds and seals the second interior bladder chamber, (iii) the third seam completely surrounds and seals the third interior bladder chamber, (iv) the fourth seam completely surrounds and seals the fourth interior bladder chamber, and (v) the first interior bladder chamber, the second interior bladder chamber, the third interior bladder chamber, and the fourth interior bladder chamber are not in fluid communication with one another.

Clause 69. The upper according to clause 65, further comprising: a fifth bladder pod including a fifth seam that defines a fifth interior bladder chamber; and a fourth elastic connector engaging the fourth seam and the fifth seam.

Clause 70. The upper according to clause 69, wherein: (i) the first seam completely surrounds and seals the first interior bladder chamber, (ii) the second seam completely surrounds and seals the second interior bladder chamber, (iii) the third seam completely surrounds and seals the third interior bladder chamber, (iv) the fourth seam completely surrounds and seals the fourth interior bladder chamber, (v) the fifth seam completely surrounds and seals the fifth interior bladder chamber, and (vi) the first interior bladder chamber, the second interior bladder chamber, the third interior bladder chamber, the fourth interior bladder chamber, and the fifth interior bladder chamber are not in fluid communication with one another.

Clause 71. The upper according to clause 69, further comprising: a sixth bladder pod including a sixth seam that defines a sixth interior bladder chamber; and a fifth elastic connector engaging the fifth seam and the sixth seam.

Clause 72. The upper according to clause 71, further comprising: a seventh bladder pod including a seventh seam that defines a seventh interior bladder chamber; and a sixth elastic connector engaging the sixth seam and the seventh seam.

Clause 73. The upper according to clause 71, further comprising a sixth elastic connector engaging the sixth seam and the first seam.

Clause 74. The upper according to clause 73, wherein the first bladder pod, the first elastic connector, the second bladder pod, the second elastic connector, the third bladder pod, the third elastic connector, the fourth bladder pod, the fourth elastic connector, the fifth bladder pod, the fifth elastic connector, the sixth bladder pod, and the sixth elastic connector are arranged in a closed loop and configured to extend completely around the ankle covering portion of the upper.

Clause 75. The upper according to any one of clauses 71 to 73, wherein: (i) the first seam completely surrounds and seals the first interior bladder chamber, (ii) the second seam completely surrounds and seals the second interior bladder chamber, (iii) the third seam completely surrounds and seals the third interior bladder chamber, (iv) the fourth seam completely surrounds and seals the fourth interior bladder chamber, (v) the fifth seam completely surrounds and seals the fifth interior bladder chamber, (vi) the sixth seam completely surrounds and seals the sixth interior bladder chamber, and (vii) the first interior bladder chamber, the second interior bladder chamber, the third interior bladder chamber, the fourth interior bladder chamber, the fifth interior bladder chamber, and the sixth interior bladder chamber are not in fluid communication with one another.

Clause 76. The upper according to clause 61, wherein the first interior bladder chamber is in fluid communication with the second interior bladder chamber.

Clause 77. The upper according to clause 76, wherein a first fluid channel extends between and connects the first interior bladder chamber with the second interior bladder chamber.

Clause 78. The upper according to clause 61, further comprising: a third bladder pod including a third seam that defines a third interior bladder chamber, wherein the first elastic connector engages the third seam.

Clause 79. The upper according to clause 78, wherein the first interior bladder chamber, the second interior bladder chamber, and the third interior bladder chamber are not in fluid communication with one another.

Clause 80. The upper according to clause 78, wherein the first interior bladder chamber, the second interior bladder chamber, and the third interior bladder chamber are in fluid communication with one another.

Clause 81. The upper according to any one of clauses 78 to 80, wherein the third bladder pod includes a first pod chamber, a second pod chamber, and a fluid passage connecting the first pod chamber and the second pod chamber to place the first pod chamber in fluid communication with the second pod chamber.

Clause 82. The upper according to clause 81, wherein the fluid passage extends around a rear heel area of the upper such that the first pod chamber is located on a first side of the upper and the second pod chamber is located on a second side of the upper.

Clause 83. The upper according to any one of clauses 78 to 82, wherein the first elastic connector is located at a medial ankle portion of the upper.

Clause 84. The upper according to any one of clauses 78 to 82, wherein the first elastic connector is located at a lateral ankle portion of the upper.

Clause 85. The upper according to clause 61, wherein a first joining seam portion extends between and connects the first seam and the second seam.

Clause 86. The upper according to clause 85, wherein the first interior bladder chamber and the second interior bladder chamber are not in fluid communication with one another.

Clause 87. The upper according to clause 85, wherein the first interior bladder chamber and the second interior bladder chamber are in fluid communication with one another.

Clause 88. The upper according to clause 61, further comprising: a third bladder pod including a third seam that defines a third interior bladder chamber; and a second elastic connector engaging the second seam and the third seam, wherein: (i) a first joining seam portion extends between and connects the first seam and the second seam, and (ii) a second joining seam portion extends between and connects the second seam and the third seam.

Clause 89. The upper according to clause 88, wherein the first interior bladder chamber, the second interior bladder chamber, and the third interior bladder chamber are not in fluid communication with one another.

Clause 90. The upper according to clause 88, wherein the first interior bladder chamber, the second interior bladder chamber, and the third interior bladder chamber are in fluid communication with one another.

Clause 91. The upper according to clause 90, wherein: (i) a first fluid channel extends between and connects the first interior bladder chamber with the second interior bladder chamber, and (ii) a second fluid channel extends between and connects the second interior bladder chamber with the third interior bladder chamber.

Clause 92. The upper according to clause 88, further comprising: a fourth bladder pod including a fourth seam that defines a fourth interior bladder chamber; and a third elastic connector engaging the third seam and the fourth seam.

Clause 93. The upper according to clause 92, further comprising: a fourth elastic connector engaging the fourth seam and the first seam.

Clause 94. The upper according to clause 93, wherein the first bladder pod, the first elastic connector, the second bladder pod, the second elastic connector, the third bladder pod, the third elastic connector, the fourth bladder pod, and the fourth elastic connector are arranged in a closed loop and configured to extend completely around the ankle covering portion of the upper.

Clause 95. The upper according to clause 92, wherein: (i) a third joining seam portion extends between and connects the third seam and the fourth seam.

Clause 96. The upper according to any one of clauses 92 to 95, wherein the first interior bladder chamber, the second interior bladder chamber, the third interior bladder chamber, and the fourth interior bladder chamber are not in fluid communication with one another.

Clause 97. The upper according to any one of clauses 92 to 95, wherein the first interior bladder chamber, the second interior bladder chamber, the third interior bladder chamber, and the fourth interior bladder chamber are in fluid communication with one another.

Clause 98. The upper according to clause 97, wherein: (i) a first fluid channel extends between and connects the first interior bladder chamber with the second interior bladder chamber, (ii) a second fluid channel extends between and connects the second interior bladder chamber with the third interior bladder chamber, and (iii) a third fluid channel extends between and connects the third interior bladder chamber with the fourth interior bladder chamber.

Clause 99. The upper according to clause 92, further comprising: a fifth bladder pod including a fifth seam that defines a fifth interior bladder chamber; and a fourth elastic connector engaging the fourth seam and the fifth seam.

Clause 100. The upper according to clause 99, wherein: (i) a third joining seam portion extends between and connects the third seam and the fourth seam, and (ii) a fourth joining seam portion extends between and connects the fourth seam and the fifth seam.

Clause 101. The upper according to clause 99 or 100, wherein the first interior bladder chamber, the second interior bladder chamber, the third interior bladder chamber, the fourth interior bladder chamber, and the fifth interior bladder chamber are not in fluid communication with one another.

Clause 102. The upper according to clause 99 or 100, wherein the first interior bladder chamber, the second interior bladder chamber, the third interior bladder chamber, the fourth interior bladder chamber, and the fifth interior bladder chamber are in fluid communication with one another.

Clause 103. The upper according to clause 102, wherein: (i) a first fluid channel extends between and connects the first interior bladder chamber with the second interior bladder chamber, (ii) a second fluid channel extends between and connects the second interior bladder chamber with the third interior bladder chamber, (iii) a third fluid channel extends between and connects the third interior bladder chamber with the fourth interior bladder chamber, and (iv) a fourth fluid channel extends between and connects the fourth interior bladder chamber with the fifth interior bladder chamber.

Clause 104. The upper according to clause 99, further comprising: a sixth bladder pod including a sixth seam that defines a sixth interior bladder chamber; and a fifth elastic connector engaging the fifth seam and the sixth seam.

Clause 105. The upper according to clause 104, further comprising: a seventh bladder pod including a seventh seam that defines a seventh interior bladder chamber; and a sixth elastic connector engaging the sixth seam and the seventh seam.

Clause 106. The upper according to clause 104, further comprising a sixth elastic connector engaging the sixth seam and the first seam.

Clause 107. The upper according to clause 106, wherein the first bladder pod, the first elastic connector, the second bladder pod, the second elastic connector, the third bladder pod, the third elastic connector, the fourth bladder pod, the fourth elastic connector, the fifth bladder pod, the fifth elastic connector, the sixth bladder pod, and the sixth elastic connector are arranged in a closed loop and configured to extend completely around the ankle covering portion of the upper.

Clause 108. The upper according to clause 104 or 106, wherein: (i) a third joining seam portion extends between and connects the third seam and the fourth seam, (ii) a fourth joining seam portion extends between and connects the fourth seam and the fifth seam, and (iii) a fifth joining seam portion extends between and connects the fifth seam and the sixth seam.

Clause 109. The upper according to any one of clauses 104, 106, or 108, wherein the first interior bladder chamber, the second interior bladder chamber, the third interior bladder chamber, the fourth interior bladder chamber, the fifth interior bladder chamber, and the sixth interior bladder chamber are not in fluid communication with one another.

Clause 110. The upper according to any one of clauses 104, 106, or 108, wherein the first interior bladder chamber, the second interior bladder chamber, the third interior bladder chamber, the fourth interior bladder chamber, the fifth interior bladder chamber, and the sixth interior bladder chamber are in fluid communication with one another.

Clause 111. The upper according to clause 110, wherein: (i) a first fluid channel extends between and connects the first interior bladder chamber with the second interior bladder chamber, (ii) a second fluid channel extends between and connects the second interior bladder chamber with the third interior bladder chamber, (iii) a third fluid channel extends between and connects the third interior bladder chamber with the fourth interior bladder chamber, (iv) a fourth fluid channel extends between and connects the fourth interior bladder chamber with the fifth interior bladder chamber, and (v) a fifth fluid channel extends between and connects the fifth interior bladder chamber with the sixth interior bladder chamber.

Clause 112. The upper according to clause 61, wherein the first bladder pod constitutes a separate component from the second bladder pod.

Clause 113. The upper according to clause 112, wherein the first elastic connector is the only structural element extending between the first bladder pod and the second bladder pod.

Clause 114. The upper according to clause 61, further comprising: a third bladder pod including a third seam that defines a third interior bladder chamber; and a second elastic connector engaging the second seam and the third seam, wherein the first bladder pod, the second bladder pod, and the third bladder pod constitute separate components.

Clause 115. The upper according to clause 114, wherein: (i) the first elastic connector is the only structural element extending between the first bladder pod and the second bladder pod, and (ii) the second elastic connector is the only structural element extending between the second bladder pod and the third bladder pod.

Clause 116. The upper according to clause 114, further comprising: a fourth bladder pod including a fourth seam that defines a fourth interior bladder chamber; and a third elastic connector engaging the third seam and the fourth seam, wherein the first bladder pod, the second bladder pod, the third bladder pod, and the fourth bladder pod constitute separate components.

Clause 117. The upper according to clause 116, further comprising: a fourth elastic connector engaging the fourth seam and the first seam.

Clause 118. The upper according to clause 117, wherein the first bladder pod, the first elastic connector, the second bladder pod, the second elastic connector, the third bladder pod, the third elastic connector, the fourth bladder pod, and the fourth elastic connector are arranged in a closed loop and configured to extend completely around the ankle covering portion of the upper.

Clause 119. The upper according to clause 116, wherein: (i) the first elastic connector is the only structural element extending between the first bladder pod and the second bladder pod, (ii) the second elastic connector is the only structural element extending between the second bladder pod and the third bladder pod, and (iii) the third elastic connector is the only structural element extending between the third bladder pod and the fourth bladder pod.

Clause 120. The upper according to clause 116, further comprising: a fifth bladder pod including a fifth seam that defines a fifth interior bladder chamber; and a fourth elastic connector engaging the fourth seam and the fifth seam, wherein the first bladder pod, the second bladder pod, the third bladder pod, the fourth bladder pod, and the fifth bladder pod constitute separate components.

Clause 121. The upper according to clause 120, wherein: (i) the first elastic connector is the only structural element extending between the first bladder pod and the second bladder pod, (ii) the second elastic connector is the only structural element extending between the second bladder pod and the third bladder pod, (iii) the third elastic connector is the only structural element extending between the third bladder pod and the fourth bladder pod, and (iv) the fourth elastic connector is the only structural element extending between the fourth bladder pod and the fifth bladder pod.

Clause 122. The upper according to clause 120, further comprising: a sixth bladder pod including a sixth seam that defines a sixth interior bladder chamber; and a fifth elastic connector engaging the fifth seam and the sixth seam, wherein the first bladder pod, the second bladder pod, the third bladder pod, the fourth bladder pod, the fifth bladder pod, and the sixth bladder pod constitute separate components.

Clause 123. The upper according to clause 122, further comprising: a seventh bladder pod including a seventh seam that defines a seventh interior bladder chamber; and a sixth elastic connector engaging the sixth seam and the seventh seam, wherein the first bladder pod, the second bladder pod, the third bladder pod, the fourth bladder pod, the fifth bladder pod, the sixth bladder pod, and the seventh bladder pod constitute separate components.

Clause 124. The upper according to clause 122, wherein: (i) the first elastic connector is the only structural element extending between the first bladder pod and the second bladder pod, (ii) the second elastic connector is the only structural element extending between the second bladder pod and the third bladder pod, (iii) the third elastic connector is the only structural element extending between the third bladder pod and the fourth bladder pod, (iv) the fourth elastic connector is the only structural element extending between the fourth bladder pod and the fifth bladder pod, and (v) the fifth elastic connector is the only structural element extending between the fifth bladder pod and the sixth bladder pod.

Clause 125. The upper according to clause 122 or 124, further comprising: a sixth elastic connector engaging the sixth seam and the first seam.

Clause 126. The upper according to clause 125, wherein the first bladder pod, the first elastic connector, the second bladder pod, the second elastic connector, the third bladder pod, the third elastic connector, the fourth bladder pod, the fourth elastic connector, the fifth bladder pod, the fifth elastic connector, the sixth bladder pod, and the sixth elastic connector are arranged in a closed loop and configured to extend completely around the ankle covering portion of the upper.

Clause 127. The upper according to clause 125, wherein: (i) the first elastic connector is the only structural element extending between the first bladder pod and the second bladder pod, (ii) the second elastic connector is the only structural element extending between the second bladder pod and the third bladder pod, (iii) the third elastic connector is the only structural element extending between the third bladder pod and the fourth bladder pod, (iv) the fourth elastic connector is the only structural element extending between the fourth bladder pod and the fifth bladder pod, (v) the fifth elastic connector is the only structural element extending between the fifth bladder pod and the sixth bladder pod, and (vi) the sixth elastic connector is the only structural element extending between the sixth bladder pod and the first bladder pod.

Clause 128. The upper according to clause 61, further comprising: a third bladder pod including a third seam that defines a third interior bladder chamber, wherein the third bladder pod is connected to at least one of the first bladder pod or the second bladder pod.

Clause 129. The upper according to clause 128, wherein the third bladder pod is connected to at least one of the first bladder pod or the second bladder pod by a second elastic connector.

Clause 130. The upper according to clause 128, further comprising: a fourth bladder pod including a fourth seam that defines a fourth interior bladder chamber, wherein the fourth bladder pod is connected to the third bladder pod.

Clause 131. The upper according to clause 128, further comprising: a fourth bladder pod including a fourth seam that defines a fourth interior bladder chamber, wherein the fourth bladder pod is connected to the third bladder pod and to the first bladder pod such that the first bladder pod, the second bladder pod, the third bladder pod, and the fourth bladder pod are connected to form a closed loop at the ankle covering portion of the upper.

Clause 132. The upper according to clause 130 or 131, wherein the third bladder pod is connected to at least one of the first bladder pod or the second bladder pod by a second elastic connector and/or wherein the fourth bladder pod is connected to the third bladder pod by a third elastic connector.

Clause 133. The upper according to clause 61, further comprising: a third bladder pod including a third seam that defines a third interior bladder chamber, wherein the third bladder pod is connected to the second bladder pod; a fourth bladder pod including a fourth seam that defines a fourth interior bladder chamber, wherein the fourth bladder pod is connected to the third bladder pod; and a fifth bladder pod including a fifth seam that defines a fifth interior bladder chamber, wherein the fifth bladder pod is connected to the fourth bladder pod.

Clause 134. The upper according to clause 133, wherein: (i) the third bladder pod is connected to the second bladder pod by a second elastic connector, (ii) the fourth bladder pod is connected to the third bladder pod by a third elastic connector, and/or (iii) the fifth bladder pod is connected to the fourth bladder pod by a fourth elastic connector.

Clause 135. The upper according to clause 61, further comprising: a third bladder pod including a third seam that defines a third interior bladder chamber, wherein the third bladder pod is connected to the second bladder pod; a fourth bladder pod including a fourth seam that defines a fourth interior bladder chamber, wherein the fourth bladder pod is connected to the third bladder pod; a fifth bladder pod including a fifth seam that defines a fifth interior bladder chamber, wherein the fifth bladder pod is connected to the fourth bladder pod; and a sixth bladder pod including a sixth seam that defines a sixth interior bladder chamber, wherein the sixth bladder pod is connected to the fifth bladder pod.

Clause 136. The upper according to clause 135, wherein: (i) the third bladder pod is connected to the second bladder pod by a second elastic connector, (ii) the fourth bladder pod is connected to the third bladder pod by a third elastic connector, (iii) the fifth bladder pod is connected to the fourth bladder pod by a fourth elastic connector; and/or (iv) the sixth bladder pod is connected to the fifth bladder pod by a fifth elastic connector.

Clause 137. The upper according to clause 135 or 136, wherein the sixth bladder pod is further connected to the first bladder pod such that the first bladder pod, the second bladder pod, the third bladder pod, the fourth bladder pod, the fifth bladder pod, and the sixth bladder pod are connected to form a closed loop at the ankle covering portion of the upper.

Clause 138. The upper according to clause 61, further comprising: a third bladder pod including a third seam that defines a third interior bladder chamber, wherein the third bladder pod is connected to the second bladder pod; a fourth bladder pod including a fourth seam that defines a fourth interior bladder chamber, wherein the fourth bladder pod is connected to the third bladder pod; a fifth bladder pod including a fifth seam that defines a fifth interior bladder chamber, wherein the fifth bladder pod is connected to the fourth bladder pod; a sixth bladder pod including a sixth seam that defines a sixth interior bladder chamber, wherein the sixth bladder pod is connected to the fifth bladder pod; and a seventh bladder pod including a seventh seam that defines a seventh interior bladder chamber, wherein the seventh bladder pod is connected to the sixth bladder pod.

Clause 139. The upper according to clause 138, wherein: (i) the third bladder pod is connected to the second bladder pod by a second elastic connector, (ii) the fourth bladder pod is connected to the third bladder pod by a third elastic connector, (iii) the fifth bladder pod is connected to the fourth bladder pod by a fourth elastic connector; (iv) the sixth bladder pod is connected to the fifth bladder pod by a fifth elastic connector; and/or (v) the seventh bladder pod is connected to the sixth bladder pod by a sixth elastic connector.

Clause 140. The upper according to clause 61, wherein the second bladder pod includes a first pod chamber, a second pod chamber, and a fluid passage connecting the first pod chamber and the second pod chamber to place the first pod chamber in fluid communication with the second pod chamber.

Clause 141. The upper according to clause 140, wherein the fluid passage extends around a rear heel area of the upper such that the first pod chamber is located on a first side of the upper and the second pod chamber is located on a second side of the upper.

Clause 142. The upper according to clause 140 or 141, wherein the first elastic connector is located at a medial ankle portion of the upper.

Clause 143. The upper according to clause 140 or 141, wherein the first elastic connector is located at a lateral ankle portion of the upper.

Clause 144. An article of footwear, comprising:

an upper according to any one of clauses 61 to 143; and a sole structure engaged with the upper.

Clause 145. A bladder system for an article of footwear, comprising:

a first bladder pod that defines a first interior bladder chamber;

a second bladder pod that defines a second interior bladder chamber, wherein the first bladder pod and the second bladder pod are at least partially separated by a first gap; and a first elastic connector engaging the first bladder pod and the second bladder pod and spanning the first gap.

Clause 146. The bladder system according to clause 145, wherein the first interior bladder chamber is not in fluid communication with the second interior bladder chamber.

Clause 147. The bladder system according to clause 145, further comprising a third bladder pod that defines a third interior bladder chamber, wherein the third bladder pod is at least partially separated from the second bladder pod by a second gap, and wherein the first elastic connector engages the third bladder pod and spans the second gap.

Clause 148. The bladder system according to clause 147, wherein the first interior bladder chamber, the second interior bladder chamber, and the third interior bladder chamber are not in fluid communication with one another.

Clause 149. The bladder system according to clause 147, wherein two or more of the first interior bladder chamber, the second interior bladder chamber, and the third interior bladder chamber are in fluid communication with one another.

Clause 150. The bladder system according to clause 147, further comprising a fourth bladder pod that defines a fourth interior bladder chamber, wherein the fourth bladder pod is at least partially separated from the third bladder pod by a third gap, and wherein the first elastic connector engages the fourth bladder pod and spans the third gap.

Clause 151. The bladder system according to clause 150, wherein the first interior bladder chamber, the second interior bladder chamber, the third interior bladder chamber, and the fourth interior bladder chamber are not in fluid communication with one another.

Clause 152. The bladder system according to clause 150, wherein two or more of the first interior bladder chamber, the second interior bladder chamber, the third interior bladder chamber, and the fourth interior bladder chamber are in fluid communication with one another.

Clause 153. The bladder system according to clause 150, further comprising a fifth bladder pod that defines a fifth interior bladder chamber, wherein the fifth bladder pod is at least partially separated from the fourth bladder pod by a fourth gap, and wherein the first elastic connector engages the fifth bladder pod and spans the fourth gap.

Clause 154. The bladder system according to clause 153, wherein the first interior bladder chamber, the second interior bladder chamber, the third interior bladder chamber, the fourth interior bladder chamber, and the fifth interior bladder chamber are not in fluid communication with one another.

Clause 155. The bladder system according to clause 153, wherein two or more of the first interior bladder chamber, the second interior bladder chamber, the third interior bladder chamber, the fourth interior bladder chamber, and the fifth interior bladder chamber are in fluid communication with one another.

Clause 156. The bladder system according to clause 153, further comprising a sixth bladder pod that defines a sixth interior bladder chamber, wherein the sixth bladder pod is at least partially separated from the fifth bladder pod by a fifth gap, and wherein the first elastic connector engages the sixth bladder pod and spans the fifth gap.

Clause 157. The bladder system according to clause 156, further comprising a seventh bladder pod that defines a seventh interior bladder chamber, wherein the seventh bladder pod is at least partially separated from the sixth bladder pod by a sixth gap, and wherein the first elastic connector engages the seventh bladder pod and spans the sixth gap.

Clause 158. The bladder system according to clause 156 or 157, wherein the first interior bladder chamber, the second interior bladder chamber, the third interior bladder chamber, the fourth interior bladder chamber, the fifth interior bladder chamber, and the sixth interior bladder chamber are not in fluid communication with one another.

Clause 159. The bladder system according to clause 156 or 157, wherein at least two of the first interior bladder chamber, the second interior bladder chamber, the third interior bladder chamber, the fourth interior bladder chamber, the fifth interior bladder chamber, and the sixth interior bladder chamber are in fluid communication with one another.

Clause 160. The bladder system according to clause 145, wherein the first interior bladder chamber is in fluid communication with the second interior bladder chamber.

Clause 161. The bladder system according to clause 160, wherein a first fluid channel extends between and connects the first interior bladder chamber with the second interior bladder chamber.

Clause 162. The bladder system according to clause 145, further comprising a third bladder pod that defines a third interior bladder chamber, wherein the first elastic connector engages the third bladder pod.

Clause 163. The bladder system according to clause 162, wherein the first interior bladder chamber, the second interior bladder chamber, and the third interior bladder chamber are not in fluid communication with one another.

Clause 164. The bladder system according to clause 162, wherein the first interior bladder chamber, the second interior bladder chamber, and the third interior bladder chamber are in fluid communication with one another.

Clause 165. The bladder system according to any one of clauses 162 to 164, wherein the third bladder pod includes a first pod chamber, a second pod chamber, and a fluid passage connecting the first pod chamber and the second pod chamber to place the first pod chamber in fluid communication with the second pod chamber.

Clause 166. The bladder system according to clause 145, wherein the first bladder pod constitutes a separate component from the second bladder pod.

Clause 167. The bladder system according to clause 145, further comprising a third bladder pod that defines a third interior bladder chamber, wherein the third bladder pod is at least partially separated from the second bladder pod by a second gap, wherein the first elastic connector engages the third bladder pod and spans the second gap, and wherein the first bladder pod, the second bladder pod, and the third bladder pod constitute separate components.

Clause 168. The bladder system according to clause 167, further comprising a fourth bladder pod that defines a fourth interior bladder chamber, wherein the fourth bladder pod is at least partially separated from the third bladder pod by a third gap, wherein the first elastic connector engages the fourth bladder pod and spans the third gap, and wherein the first bladder pod, the second bladder pod, the third bladder pod, and the fourth bladder pod constitute separate components.

Clause 169. The bladder system according to clause 168, further comprising a fifth bladder pod that defines a fifth interior bladder chamber, wherein the fifth bladder pod is at least partially separated from the fourth bladder pod by a fourth gap, wherein the first elastic connector engages the fifth bladder pod and spans the fourth gap, and wherein the first bladder pod, the second bladder pod, the third bladder pod, the fourth bladder pod, and the fifth bladder pod constitute separate components.

Clause 170. The bladder system according to clause 169, further comprising a sixth bladder pod that defines a sixth interior bladder chamber, wherein the sixth bladder pod is at least partially separated from the fifth bladder pod by a fifth gap, wherein the first elastic connector engages the sixth bladder pod and spans the fifth gap, and wherein the first bladder pod, the second bladder pod, the third bladder pod, the fourth bladder pod, the fifth bladder pod, and the sixth bladder pod constitute separate components.

Clause 171. The bladder system according to clause 170, further comprising a seventh bladder pod that defines a seventh interior bladder chamber, wherein the seventh bladder pod is at least partially separated from the sixth bladder pod by a sixth gap, wherein the first elastic connector engages the seventh bladder pod and spans the sixth gap, and wherein the first bladder pod, the second bladder pod, the third bladder pod, the fourth bladder pod, the fifth bladder pod, the sixth bladder pod, and the seventh bladder pod constitute separate components.

Clause 172. An upper for an article of footwear, comprising:

an upper base component including one or more upper component parts; and a bladder system according to any one of clauses 145 to 171 engaged with the upper base component.

Clause 173. An article of footwear, comprising:

an upper base component including one or more upper component parts;

a bladder system according to any one of clauses 145 to 171 engaged with the upper base component; and a sole structure engaged with the upper base component.

Clause 174. An upper for an article of footwear, comprising:

a first bladder pod that defines a first interior bladder chamber;

a second bladder pod that defines a second interior bladder chamber, wherein the first bladder pod and the second bladder pod are at least partially separated by a first gap; and a first upper component engaging the first bladder pod and the second bladder pod, wherein the first upper component includes a first elastic material portion located in the first gap.

Clause 175. The upper according to clause 174, wherein the first interior bladder chamber is not in fluid communication with the second interior bladder chamber.

Clause 176. The upper according to clause 174, further comprising a third bladder pod that defines a third interior bladder chamber, wherein the third bladder pod is at least partially separated from the second bladder pod by a second gap, wherein the first upper component engages the third bladder pod, and wherein the first upper component includes a second elastic material portion located in the second gap.

Clause 177. The upper according to clause 176, wherein the first interior bladder chamber, the second interior bladder chamber, and the third interior bladder chamber are not in fluid communication with one another.

Clause 178. The upper according to clause 176, wherein two or more of the first interior bladder chamber, the second interior bladder chamber, and the third interior bladder chamber are in fluid communication with one another.

Clause 179. The upper according to clause 176, further comprising a fourth bladder pod that defines a fourth interior bladder chamber, wherein the fourth bladder pod is at least partially separated from the third bladder pod by a third gap, wherein the first upper component engages the fourth bladder pod, and wherein the first upper component includes a third elastic material portion located in the third gap.

Clause 180. The upper according to clause 179, wherein the first interior bladder chamber, the second interior bladder chamber, the third interior bladder chamber, and the fourth interior bladder chamber are not in fluid communication with one another.

Clause 181. The upper according to clause 179, wherein two or more of the first interior bladder chamber, the second interior bladder chamber, the third interior bladder chamber, and the fourth interior bladder chamber are in fluid communication with one another.

Clause 182. The upper according to clause 179, further comprising a fifth bladder pod that defines a fifth interior bladder chamber, wherein the fifth bladder pod is at least partially separated from the fourth bladder pod by a fourth gap, wherein the first upper component engages the fifth bladder pod, and wherein the first upper component includes a fourth elastic material portion located in the fourth gap.

Clause 183. The upper according to clause 182, wherein the first interior bladder chamber, the second interior bladder chamber, the third interior bladder chamber, the fourth interior bladder chamber, and the fifth interior bladder chamber are not in fluid communication with one another.

Clause 184. The upper according to clause 182, wherein two or more of the first interior bladder chamber, the second interior bladder chamber, the third interior bladder chamber, the fourth interior bladder chamber, and the fifth interior bladder chamber are in fluid communication with one another.

Clause 185. The upper according to clause 182, further comprising a sixth bladder pod that defines a sixth interior bladder chamber, wherein the sixth bladder pod is at least partially separated from the fifth bladder pod by a fifth gap, wherein the first upper component engages the sixth bladder pod, and wherein the first upper component includes a fifth elastic material portion located in the fifth gap.

Clause 186. The upper according to clause 185, further comprising a seventh bladder pod that defines a seventh interior bladder chamber, wherein the seventh bladder pod is at least partially separated from the sixth bladder pod by a sixth gap, wherein the first upper component engages the seventh bladder pod, and wherein the first upper component includes a sixth elastic material portion located in the sixth gap.

Clause 187. The upper according to clause 185 or 186, wherein the first interior bladder chamber, the second interior bladder chamber, the third interior bladder chamber, the fourth interior bladder chamber, the fifth interior bladder chamber, and the sixth interior bladder chamber are not in fluid communication with one another.

Clause 188. The upper according to clause 185 or 186, wherein at least two of the first interior bladder chamber, the second interior bladder chamber, the third interior bladder chamber, the fourth interior bladder chamber, the fifth interior bladder chamber, and the sixth interior bladder chamber are in fluid communication with one another.

Clause 189. The upper according to clause 174, wherein the first interior bladder chamber is in fluid communication with the second interior bladder chamber.

Clause 190. An article of footwear, comprising:

an upper according to any one of clauses 174 to 189; and a sole structure engaged with the upper.

What is claimed is:

1. An upper for an article of footwear, comprising:

an upper base component including one or more upper component parts; and a bladder system engaged with the upper base component, wherein the bladder system is located at an ankle covering portion and/or a heel covering portion of the upper base component and includes:

a first bladder pod including a first seam that defines a first interior bladder chamber, a second bladder pod including a second seam that defines a second interior bladder chamber, a first elastic connector engaging the first seam of the first bladder pod and the second seam of the second bladder pod; and a third bladder pod including a third seam that defines a third interior bladder chamber;

wherein: (i) the first seam completely surrounds and seals the first interior bladder chamber, (ii) the second seam completely surrounds and seals the second interior bladder chamber, and (iii) the first interior bladder chamber is not in fluid communication with the second interior bladder chamber;

wherein the first elastic connector is configured to generally fit over a wearer's medial malleolus;

wherein the third bladder pod includes a first pod chamber, a second pod chamber, and a fluid passage connecting the first pod chamber of the third bladder pod to the second pod chamber of the third bladder pod;

wherein the third bladder pod is configured to wrap around a rear heel area of the upper base component such that the first pod chamber is located on a medial side of the article of footwear, the second pod chamber is located on a lateral side of the article of footwear, and the fluid passage is located on a rear of the article of footwear;

wherein each of the first pod chamber of the third bladder pod and the second pod chamber of the third bladder pod are wider in a vertical direction than the fluid passage of the third bladder pod;

wherein the third bladder pod has a butterfly shape; and wherein a portion of the first pod chamber and a portion of the second pod chamber each extend above the fluid passage in a vertical direction, and wherein a portion of the first pod chamber and a portion of the second pod chamber each extend below the fluid passage in a vertical direction.

2. The upper according to claim 1, further comprising:

a second elastic connector engaging the second seam and the third seam.

3. The upper according to claim 2, wherein the third seam completely surrounds and seals the third interior bladder chamber, and (iv) the first interior bladder chamber, the second interior bladder chamber, and the third interior bladder chamber are not in fluid communication with one another.

4. An upper for an article of footwear, comprising:

an upper base component including one or more upper component parts; and a bladder system engaged with the upper base component, wherein the bladder system is located at an ankle covering portion and/or a heel covering portion of the upper base component and includes:

a first bladder pod including a first seam that defines a first interior bladder chamber, a second bladder pod including a second seam that defines a second interior bladder chamber, a third bladder pod including a third seam that defines a third interior bladder chamber, a first elastic connector engaging the first seam of the first bladder pod, the second seam of the second bladder pod, and the third seam of the third bladder pod;

wherein the third bladder pod is configured to support a heel region of a wearer's foot;

wherein the third bladder pod includes a first pod chamber, a second pod chamber, and a fluid passage connecting the first pod chamber of the third bladder pod to the second pod chamber of the third bladder pod;

wherein the third bladder pod is configured to wrap around a rear heel area of the upper base component such that the first pod chamber is located on a medial side of the article of footwear, the second pod chamber is located on a lateral side of the article of footwear, and the fluid passage is located on a rear of the article of footwear;

wherein each of the first pod chamber of the third bladder pod and the second pod chamber of the third bladder pod are wider in a vertical direction than the fluid passage of the third bladder pod;

wherein the first elastic connector is configured to generally fit over the wearer's medial malleolus;

wherein the third bladder pod has a butterfly shape; and wherein a portion of the first pod chamber and a portion of the second pod chamber each extend above the fluid passage in a vertical direction, and wherein a portion of the first pod chamber and a portion of the second pod chamber each extend below the fluid passage in a vertical direction.

5. The upper according to claim 4, wherein: (i) the first seam completely surrounds and seals the first interior bladder chamber, (ii) the second seam completely surrounds and seals the second interior bladder chamber, and (iii) the third seam completely surround and seals the third interior bladder chamber.

6. An upper for an article of footwear, comprising:

an upper base component including one or more upper component parts; and a bladder system engaged with the upper base component, wherein the bladder system is located at an ankle covering portion and/or a heel covering portion of the upper base component and includes:

a first bladder pod including a first seam that defines a first interior bladder chamber, a second bladder pod including a second seam that defines a second interior bladder chamber, a third bladder pod including a third seam that defines a third interior bladder chamber, a first elastic connector engaging the first seam of the first bladder pod, the second seam of the second bladder pod, and the third seam of the third bladder pod;

wherein the third bladder pod is configured to support a heel region of a wearer's foot;

wherein the third bladder pod includes a first pod chamber, a second pod chamber, and a fluid passage connecting the first pod chamber of the third bladder pod to the second pod chamber of the third bladder pod;

wherein the third bladder pod is configured to wrap around a rear heel area of the upper base component such that the first pod chamber is located on a medial side of the article of footwear, the second pod chamber is located on a lateral side of the article of footwear, and the fluid passage is located on a rear of the article of footwear;

wherein each of the first pod chamber of the third bladder pod and the second pod chamber of the third bladder pod are wider in a vertical direction than the fluid passage of the third bladder pod;

wherein the first elastic connector is configured to generally fit over the wearer's lateral malleolus;

wherein the third bladder pod has a butterfly shape; and wherein a portion of the first pod chamber and a portion of the second pod chamber each extend above the fluid passage in a vertical direction, and wherein a portion of the first pod chamber and a portion of the second pod chamber each extend below the fluid passage in a vertical direction.

7. The upper according to claim 6, wherein: (i) the first seam completely surrounds and seals the first interior bladder chamber, (ii) the second seam completely surrounds and seals the second interior bladder chamber, and (iii) the third seam completely surround and seals the third interior bladder chamber.

* * * * *